US010590647B2

(12) United States Patent
Haba et al.

(10) Patent No.: US 10,590,647 B2
(45) **Date of Patent: *Mar. 17, 2020**

(54) COLD ROLLED CHANNEL WITHOUT CLIP

(71) Applicant: Telling Industries, LLC, Willoughby, OH (US)

(72) Inventors: Charles Andrew Haba, Kirtland, OH (US); Stephen Charles Linch, Painesville, OH (US); Thomas Dwayne Ogle, York, SC (US)

(73) Assignee: Telling Industries, LLC, Willoughby, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/281,371

(22) Filed: Feb. 21, 2019

(65) Prior Publication Data

US 2019/0186120 A1 Jun. 20, 2019

Related U.S. Application Data

(63) Continuation-in-part of application No. 15/987,120, filed on May 23, 2018, now Pat. No. 10,309,107.
(Continued)

(51) Int. Cl.

| | |
|---|---|
| ***E04B 2/76*** | (2006.01) |
| ***E04B 1/24*** | (2006.01) |
| ***E04B 2/62*** | (2006.01) |
| ***E04C 3/09*** | (2006.01) |
| ***E04C 3/07*** | (2006.01) |
| ***E04B 1/41*** | (2006.01) |

(Continued)

(52) U.S. Cl.
CPC ..... *E04B 2/763* (2013.01); *E04B 1/2403* (2013.01); *E04B 1/40* (2013.01); *E04B 2/58* (2013.01); *E04B 2/62* (2013.01); *E04B 2/789* (2013.01); *E04C 3/07* (2013.01); *E04C 3/09* (2013.01); *E04B 2001/2448* (2013.01); *E04B 2001/405* (2013.01); *E04B 2103/06* (2013.01); *E04C 2003/026* (2013.01); *E04C 2003/0473* (2013.01)

(58) Field of Classification Search
CPC ..... E04B 2/58; E04B 2/763; E04B 2/7457; E04B 2/789; E04B 2001/405; E04C 3/07; E04C 2003/0473; E04C 2003/026; E04C 3/32; Y10T 403/7073; Y10T 428/1241
See application file for complete search history.

(56) References Cited

U.S. PATENT DOCUMENTS 3,083,794 A 4/1963 Stovall et al.
3,322,447 A 5/1967 Biggs et al.
(Continued)

FOREIGN PATENT DOCUMENTS

EP 2998456 A1 * 3/2016 ..... E04C 3/005

*Primary Examiner* — Jessie T Fonseca
(74) *Attorney, Agent, or Firm* — Edwin A. Sisson, Attorney at Law, LLC; Jeffrey J. Banyas

(57) ABSTRACT

A stud bridge member used in the construction industry to span horizontally between vertical metal framing components such as studs and used to brace the vertical metal framing components from various loads is disclosed. The stud bridge member has at least one gusset in a flange and at least one notch of a set of notches that engage with the vertical metal framing components providing a more firm support eliminating the use of a stud bridge clip and its associated costs and installation time for the vertical metal framing components.

30 Claims, 17 Drawing Sheets

Related U.S. Application Data

(60) Provisional application No. 62/663,431, filed on Apr. 27, 2018, provisional application No. 62/663,481, filed on Apr. 27, 2018, provisional application No. 62/662,839, filed on Apr. 26, 2018, provisional application No. 62/645,223, filed on Mar. 20, 2018, provisional application No. 62/644,050, filed on Mar. 16, 2018, provisional application No. 62/643,925, filed on Mar. 16, 2018.

(51) Int. Cl.

| | |
|---|---|
| ***E04B 2/58*** | (2006.01) |
| ***E04B 2/78*** | (2006.01) |
| *E04C 3/04* | (2006.01) |
| *E04C 3/02* | (2006.01) |
| *E04B 1/38* | (2006.01) |

(56) References Cited

U.S. PATENT DOCUMENTS

| | | | |
|---|---|---|---|
| 3,482,369 | A | 12/1969 | Burke et al. |
| 3,778,952 | A | 12/1973 | Soucy |
| 4,128,979 | A | 12/1978 | Price |
| 4,208,851 | A | 6/1980 | Sauer |
| D264,756 | S | 6/1982 | Andersson |
| 4,858,407 | A | 8/1989 | Smolik |
| 5,274,973 | A | 1/1994 | Liang |
| 5,606,837 | A | 3/1997 | Holizlander |
| 5,784,850 | A | 7/1998 | Elderson |
| 5,797,233 | A | 8/1998 | Hascall |
| 6,021,618 | A | 2/2000 | Elderson |
| 6,209,268 | B1 | 4/2001 | Schmidt |
| 6,418,695 | B1 | 7/2002 | Daudet |
| 6,701,689 | B2 | 3/2004 | diGirolamo |
| 6,708,460 | B1 | 3/2004 | Elderson |
| 6,748,705 | B2 | 6/2004 | Orszulak |
| 6,920,734 | B2 | 7/2005 | Elderson |
| 7,168,219 | B2 | 1/2007 | Elderson |
| 8,011,160 | B2 | 9/2011 | Rice |
| D657,891 | S | 4/2012 | Jones |
| 8,181,419 | B1 | 5/2012 | diGirolamo |
| 8,205,402 | B1 | 6/2012 | diGirolamo et al. |
| 9,523,196 | B2 | 12/2016 | Rice |
| 2002/0059773 | A1 | 5/2002 | Elderson |
| 2003/0106280 | A1 | 6/2003 | diGirolamo |
| 2004/0031224 | A1 | 2/2004 | Elderson |
| 2004/0237451 | A1 | 12/2004 | Elderson |
| 2006/0026911 | A1 | 2/2006 | Sutton |
| 2015/0082737 | A1 | 3/2015 | Brady |

* cited by examiner

COLD ROLLED CHANNEL WITHOUT CLIP

CROSS REFERENCES AND PRIORITIES

This application is a continuation in part of U.S. patent application Ser. No. 15/987,120 filed on 23 May 2018 and claims the benefit of priority of U.S. Provisional Application Nos. 62/643,925 filed on 16 Mar. 2018, 62/644,050 filed on 16 Mar. 2018, 62/645,223 filed on 20 Mar. 2018; 62/663,481 filed on 27 Apr. 2018; 62/663,431 filed on 27 Apr. 2018 and 62/662,839 filed on 26 Apr. 2018, and U.S. patent application Ser. No. 15/987,120 filed on 23 May 2018; the teachings of each of which are incorporated by reference herein in their entirety.

BACKGROUND

Vertical metal framing components are commonly used in construction. Examples of vertical metal framing components include but are not limited header systems, doorjamb systems, area separation wall systems, shaft wall systems and studs. The stud is the most well-known vertical metal framing component.

According to U.S. Pat. No. 6,708,460 (the "'460 Patent"), "[m]etal studs are used to form walls in building structures today, including load bearing walls such as exterior walls, [interior walls] and curtain walls. In a typical installation, the metal studs are secured by screws at their lower ends to a bottom track secured to a floor, and extend at their upper ends into a top track secured to overhead joists which may form the framework for an upper floor. The upper ends of the studs generally also are secured to the top track. Exterior wall materials and/or wall boards or other panels are applied to the sides of the studs to form a closed wall structure."

"The load bearing walls are subject to axial loads (compressive loads on the studs) applied to the studs through the overhead joists, and also may be subject to transverse loads (for example, exterior walls may be subject to transverse loads from wind effects) and lateral loads acting in the plane of the wall. These loads may cause flexing (including bowing, twisting or other deformation of the stud) or turning of the metal studs which may cause the [Gypsum in the] walls to crack or otherwise be flawed or damaged. In load bearing walls, this problem is structural as well as aesthetic."

"Bridging systems heretofore have been used to reinforce the metal stud walls by adding structural support between adjacent studs. Three known bridging systems include braced channel, welded channel, and block-and-strap bridging systems."

"In the braced channel bridging system, a U-shape channel spans two or more metal studs, extending through a conduit hole in the web of each stud. An angled brace is fastened to both the channel and the web of the stud, generally with screws or rivets."

"The welded channel bridging system also uses a U-shape channel which spans two or more metal studs and extends through conduit holes in the webs of the studs. The channel is then welded to the studs on one or both sides of the channel."

"In the block-and-strap bridging system, sheet metal "blocks" are fastened between adjacent studs through bent tabs at their distal ends. Then a strap is fastened to one or both sides of two or more metal studs as well as to the respective side or sides of the blocks. Thus the studs are interconnected by the blocks between the studs as well as the straps along the sides of the studs, and the blocks and straps also are connected to each other."

"The installation of metal stud wall systems, including the reinforcing bridging systems, heretofore has been a time consuming process. In a typical installation where the metal studs are fastened at their upper ends to a top track or channel, the attachment positions of the studs are marked off along the top track. Then each stud is fastened to each flange of the top track by screws. A ladder or a scaffold may be required if the top track is too high for the installer to reach. If a ladder is used, the installer climbs the ladder and fastens as many studs as he can reach to the near flange of the top track. Then he must climb down the ladder, move the ladder along the wall so that when he again climbs the ladder he can reach the next one or more studs for fastening to the top track. If a scaffold is used, much more time is expended setting up the scaffold. After doing this along one side of the wall, the process is repeated on the other side of the wall to fasten the studs to the other flange of the top track."

"The metal studs must then be fastened at their lower ends to a bottom track or channel. Each stud must be carefully aligned and squared before being fastened to the bottom track. In addition, the bridging members described above also must be installed to interconnect the metal studs at one or more points between the top and bottom tracks. Because of the time consuming nature of the installation process, fasteners can be missed or forgotten. In the welded channel bridging systems, welders and their equipment are relatively expensive, and welds also can be missed, or can be improperly formed. Defects in welds can be particularly difficult to detect."

"In addition, once the studs are installed, other trades people, such as plumbers and electricians, may remove the bridging members between two studs to give them more room to work, running plumbing lines or electrical lines, for example. If the bridging member is not replaced, the strength of the wall may be reduced."

The invention described in the '460 patent attempts to solve the problems by providing "a stud bridging/spacing member includes an elongate member having at least three longitudinally spaced apart notches for receiving and engaging therein a web of a metal stud. The notches extend at an incline to the longitudinal axis of the elongate member to accommodate different gauges of metal studs while maintaining on-center spacing of studs when assembled in a stud wall."

According to one embodiment of the invention in the '460 patent, "the notches extend inwardly at an angle of about two to about fifteen degrees relative to a perpendicular to the longitudinal axis, and more preferably about five and a half degrees to about eight degrees, and most preferably about seven degrees. The notches have a width of about 0.050 inch (about 0.13 cm) to about 0.1 inch (about 0.2 cm), more preferably about 0.065 inch (about 0.16 cm) to about 0.080 inch (about 0.20 cm), and most preferably about 0.080 inch (about 0.20 cm). The elongate member is formed of fourteen, sixteen or eighteen gauge metal (more preferably steel and most preferably galvanized steel)."

The '460 patent continues with "[t]he at least three notches generally extend laterally inwardly from laterally outer edges of the elongate member. The elongate member may include a fourth notch equally spaced between at least two of the at least three notches. Each of the at least three notches in one portion of the elongate member may be laterally aligned with a corresponding notch in another portion of the elongate member, and/or the laterally aligned notches may incline in the same direction. The sides of the notches generally are parallel, and straight."

"Further in accordance with an embodiment of the invention [disclosed in the '460 patent], the elongate member has a V-shape lateral cross-section formed by longitudinally extending planar first and second portions joined at respective longitudinal edges to form the sides and vertex of the V-shape. The elongate member further may include a pair of wing portions extending laterally outwardly from respective distal ends of the V-shape elongate member. The wing portions may extend in opposite directions from the V-shape elongate member, and each wing portion may extend a distance which is approximately one-third the width of the widest part of the V-shape elongate member. The angle of the V is at least about 90°, more preferably at least about 120° and most preferably about 130°. A shallow angle increases the transverse stiffness of the elongate member, although other means may be used for this purpose."

"In assembling a metal stud wall including a row of metal studs each having at least two flanges interconnected by a web, each stud is fastened at a lower end to a base track. A stud bridging/spacing member is inserted through aligned openings in at least three metal studs, and longitudinally spaced apart notches in the stud bridging/spacing member are engaged with respective webs of the metal studs, thereby establishing and maintaining a fixed spacing between the metal studs and reinforcing the studs against deflection and turning under loading. When the notches engage the webs of the studs, a portion of the webs of the studs generally is caused to bend (at least under load conditions) in the direction of the inclines of the notches to retain the web in the engaged notch. The assembly method may also include securing a top end of each of the studs to a ceiling track."

Review of the '460 patent, particularly FIGS. 4 and 10, shows the channel side of the bridge member pointing down, and the crease of the V on the outer channel side. There is no ability for this device to also function as a channel for mounting wiring and cabling.

SUMMARY

Disclosed herein is a stud bridge member which will have a stud bridge member width and may comprise a web, a first flange, and a second flange. The web may have a web outer side, a web inner side, a web first edge, and a web second edge defining a web plane having a longitudinal axis. The first flange and the second flange may extend into a space on the web inner side. The stud bridge member may also comprise at least one notch set comprising a first notch and a second notch and at least one gusset having a gusset outer apex.

The first flange may comprises a first flange first edge and a first flange second edge defining a first flange plane with the first flange first edge joined with the web first edge at a first juncture having a first juncture outside angle ($\Theta_{M1}$) from the web outer side to the first flange, with a corresponding explementary inner angle ($\alpha_{M1}$), with the first juncture forming a first juncture line which is substantially parallel to the longitudinal axis.

The second flange comprises a second flange first edge and a second flange second edge defining a second flange plane with the second flange first edge joined with the web second edge at a second juncture having a second juncture outside angle ($\Theta_{M2}$) from the web outer side to the second flange, with a corresponding explementary inner angle ($\alpha_{M2}$), with the second juncture forming a second juncture line which is substantially parallel to the longitudinal axis.

The first juncture line, the first flange first edge, the first flange second edge, the second juncture line, the second flange first edge, and the second flange second edge can be substantially parallel to the longitudinal axis.

The first notch may comprise a first notch length, a first notch width measured perpendicular to the first notch length, and a first notch cut plane. The first notch length begins in the first flange at a first flange notch point and extends at least through the first juncture and to a web first notch point.

The second notch may comprise a second notch length, a second notch width measured perpendicular to the second notch length, and a second notch cut plane. The second notch length begins in the first flange at a first flange notch point and extends at least through the first juncture and to a web second notch point wherein a line passing from the web first notch point to the web second notch point is perpendicular to the longitudinal axis.

The at least one gusset extends from the first flange second edge to at least the first flange notch point or from the second flange second edge to at least the second flange notch point.

It is further disclosed that the gusset is also on the web or on the first flange and the second flange or on the web and on the first flange and on the second flange.

It is further discloses that at least one of $\alpha_{M1}$ or $\alpha_{M2}$ has a value of greater than 90° and less than about 110°, that both $\alpha_{M1}$ and $\alpha_{M2}$ may have a value of greater than 90° and less than about 110° and that both $\alpha_{M1}$ and $\alpha_{M2}$ may have substantially the same value.

It is further disclosed that the distance from the outer gusset apex to the outer edge of the opposing flange when measured perpendicular to the longitudinal axis and parallel with the web plane is less than or equal to the stud bridge member width.

It is also disclosed that the first notch or second notch are an hourglass notch.

An embodiment is further disclosed where the stud bridge member is engaged with a vertical metal framing member having a vertical metal framing member hole with vertical metal framing member hole edges and a vertical metal framing member hole depth; with the bridge member passing through the vertical metal framing member hole so that the first notch and the second notch are engaged with the vertical metal framing member hole edges; and the distance from the outer gusset apex to the outer edge of the opposing flange when measured perpendicular to the longitudinal axis is less than the vertical metal framing member hole depth.

DETAILED DESCRIPTION

Figure 1:
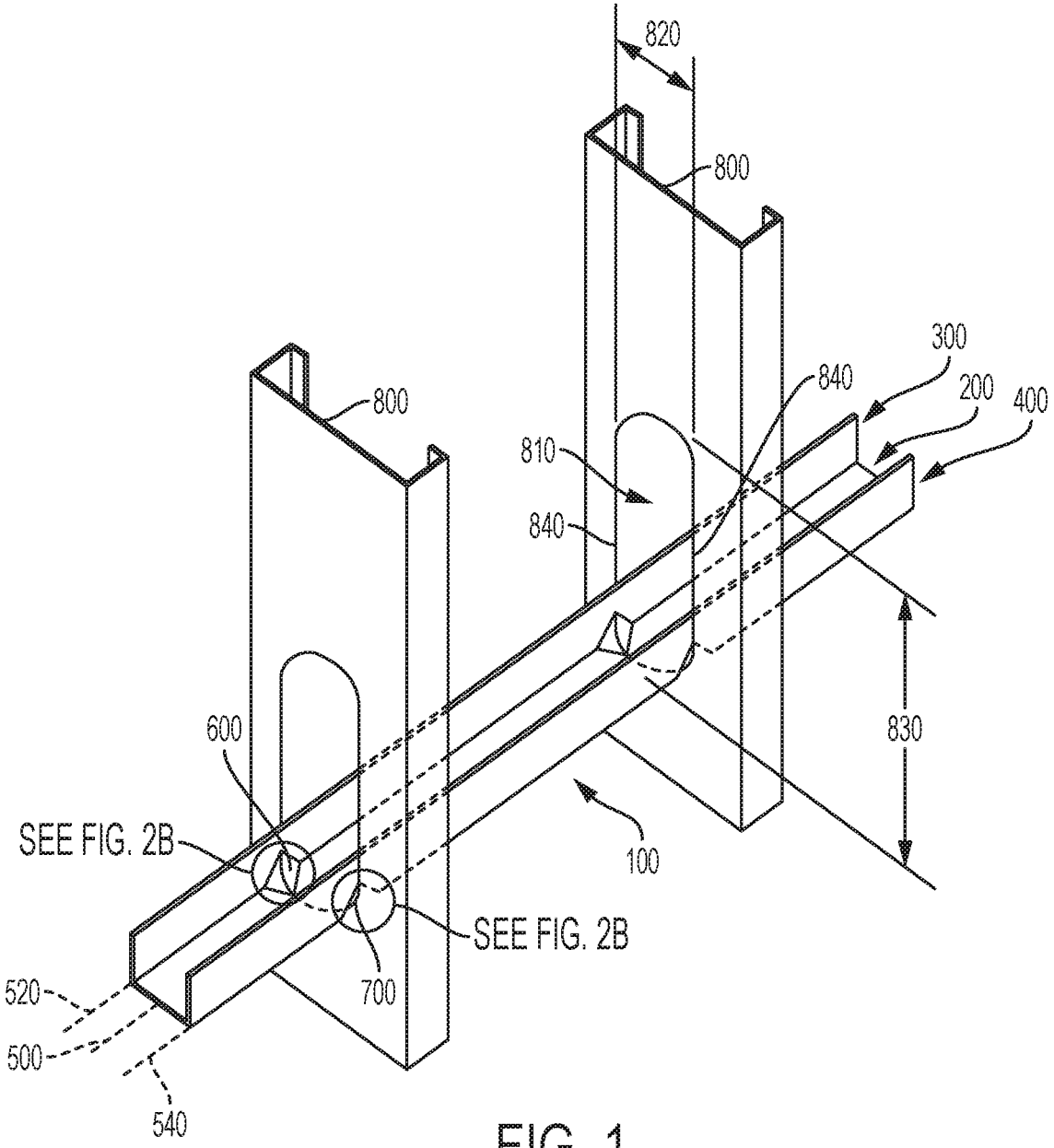
FIG. 1 depicts one embodiment of a stud bridge member as it is installed to bridge across two vertical metal framing components which in this embodiment are studs.

This invention is to an improved stud bridge member. The specification is best understood referring to FIG. 1, which is a detailed drawing of the invented stud bridge member installed to bridge across two studs. Reference will now be made to the various Figures in which, unless otherwise noted, like numbers refer to like structures. As described herein and in the claims, the following numbers refer to the following structures as noted in the Figures.

100 refers to the stud bridge member.

150 refers to the stud bridge member width measured at the inner web and perpendicular to the longitudinal axis (500).

200 refers to the web.

200A refers to the web of the inner nested bridge.

200B refers to the web of the outer nested bridge.

210 refers to the web first edge.

220 refers to the web second edge.

240 refers to the web outer side.

250 refers to the web plane on the outer side.

260 refers to the web inner side.

300 refers to the first flange.

300A refers to the first flange of the inner nested bridge.

300B refers to the first flange of the outer nested bridge.

320 refers to the first flange first edge.

340 refers to the first flange second edge.

350 refers to the first flange plane.

400 refers to the second flange.

400A refers to the second flange of the inner nested bridge.

400B refers to the second flange of the outer nested bridge.

420 refers to the second flange first edge.

440 refers to the second flange second edge.

450 refers to the second flange plane.

500 refers to the longitudinal axis.

510 refers to the first juncture.

520 refers to the first juncture line.

530 refers to the second juncture.

540 refers to the second juncture line.

600 refers to the first notch of a notch set.

620 refers to the first notch length.

630 refers to the first notch cut length and the first notch cut plane.

640 refers to the first notch width.

660 refers to the web first notch point.

665 is the web first notch length, or length of the first notch in web.

667 is the maximum web first notch width, or the maximum width of the first notch in the web.

680 refers to the first flange notch point.

685 is the first flange notch length, or length of the first notch in the first flange.

687 is the maximum first flange notch width, which is also the maximum width of the first notch in the first flange.

690 refers to the first inflection line.

700 refers to the second notch of a notch set.

720 refers to the second notch length.

730 refers to the second notch cut length and the first notch cut plane.

740 refers to the second notch width.

760 refers to the web second notch point.

780 refers to the second flange notch point.

790 refers to the second inflection line.

800 refers to the vertical metal framing component which in this case is a stud.

810 refers to the vertical metal framing component hole, which in this case is a stud hole, passing through the web of the vertical metal framing component, which in this case is a stud.

820 refers to the vertical metal framing component hole depth, which in this embodiment is the stud hole depth.

830 refers to the vertical metal framing component hole length, which in this embodiment is the stud hole length.

840 refers to the vertical metal framing component hole edges also known as the vertical component hole perimeter, which in this embodiment are stud hole edges and the stud hole perimeter, respectively.

900 refers to the gusset.

910 refers to the gusset major inner width of an embodiment.

920 refers to the gusset minor inner width of an embodiment.

921 refers to the gusset inner apex of an embodiment.

922 refers to the inner gusset depth.

930 refers to the gusset major outer width of an embodiment.

940 refers to the gusset major inner width of an embodiment.

941 refers to the gusset outer apex.

942 refers to the outer gusset depth.

950 refers to the distance from the outer gusset apex of a flange to the outer edge of the opposing flange when measured perpendicular to the longitudinal axis. The outer edge of the opposing flange may also have a gusset as shown.

951 refers to the gusset line along which the gusset extends.

1000 refers to a screw passing through two nested bridges.

$\Theta_{M1}$ refers to the first juncture outside angle.

$\alpha_{M1}$ refers to the first inner angle.

$\Theta_{M2}$ refers to the second juncture outside angle.

$\alpha_{M2}$ refers to the second inner angle.

As described in the background section, the traditional method of installing stud bridge members is to lay the stud bridge member at a hole through the stud, and then use clips on either side to secure the stud bridge member to the stud.

Advances were made to also provide stud bridge members with slots. As indicated in the background section these slots pass through the flanges of the stud bridge member. The stud bridge member is used with the channel, trough, or inner side facing down, making the stud bridge unsuitable for laying cable or wiring.

The novel stud bridge member in this specification can be installed without using a clip at each stud, thus reducing the cost and time to install. As the clips are only used at the end of each stud bridge member, a stud bridge member spanning 3 studs and clipped to 2 other studs would eliminate the time and expense of using 3 clips.

This novel stud bridge member is also installed so that the channel faces up, allowing the channel to be used for cabling or electrical lines.

Additionally, as the stud bridge member places a single horizontal metal channel across the stud and in between the studs, the stud bridge member is much stronger and not susceptible to bending as seen in the commonly used V-bridging member described in U.S. Pat. No. 6,708,460.

As the novel stud bridge member uses notches, water gathered during construction is naturally drained out of the upward facing channel through the notches.

This specification uses the term web to describe a middle planar component (200) and the term flange to describe the outer planar components (300 and 400). These terms are interchangeable.

The invented stud bridge member is best described by starting with FIG. 1. As shown in FIG. 1, the stud bridge member (100) is used between vertical metal framing components, which in this embodiment are two studs (800). The stud bridge member has a first flange (300), a web (200), and a second flange (400).

Figure 4:
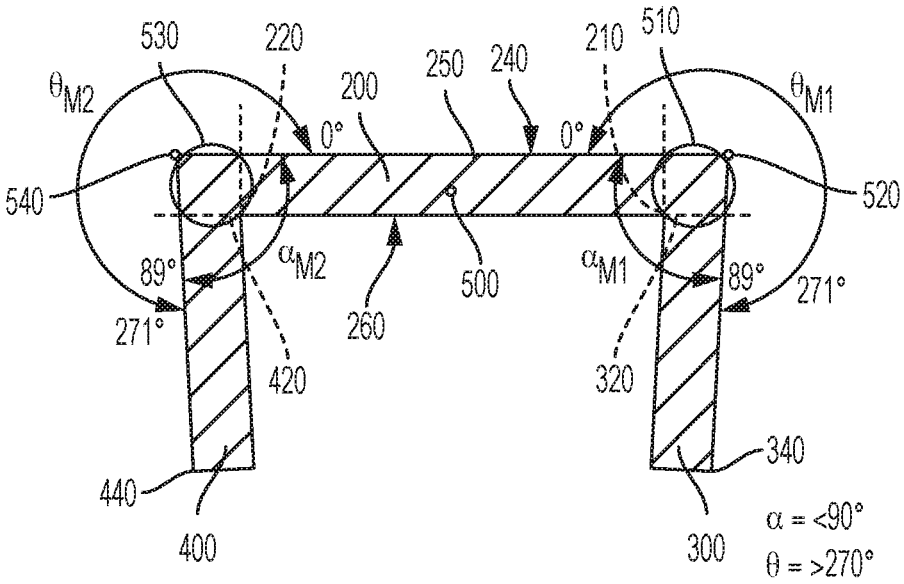
FIG. 4 is a cut-a-way center view at the point noted in FIG. 3A.

In FIG. 1, the web is joined to the first and second flanges forming a juncture line for each juncture. The first juncture line (520) is formed by the juncture (510) of the web (200) and the first flange (300). The second juncture line (540) is formed by the juncture (530) of the web (200) and the second flange (400). Reference is made to FIG. 4 for the juncture annotations (510 and 530) with each juncture defined by the dashed lines, a web portion and a portion of the corresponding flange.

Either or both of the first juncture (510) and the second juncture (530) could be a weld, a bend, glue, or any another means known where two components can be joined. The first juncture and the second juncture are not required to use the same means of joining two components together. For instance, the first juncture may be a weld while the second juncture is a bend. Preferably the stud bridge member (100) is made of a unitary piece of construction and the junctures are bends of the same piece, preferably made of metal. Examples of such metals include steel, stainless steel, iron, aluminum, copper, brass, titanium, and the like. However, the stud bridge member could alternatively be extruded through a die where it is formed into shape and could be made of a metal or plastic material.

As shown in FIG. 1, stud bridge member (100) has a longitudinal axis (500). This longitudinal axis (500) is used to orient the location of other components of the stud bridge member. The longitudinal axis is at the middle of the web (200) and runs along the web length.

The longitudinal axis (500), the first juncture line (520) and the second juncture line (540) are all preferably parallel with or substantially parallel with each other.

The stud bridge member (100) will have at least one notch set, comprised of a first notch and a second notch. As noted in FIG. 1, the notch set comprises the first notch (600) and the second notch (700). As discussed later, the notches are preferably cut to create a pinch point in the flanges to frictionally engage with the stud (800).

Figure 2A:
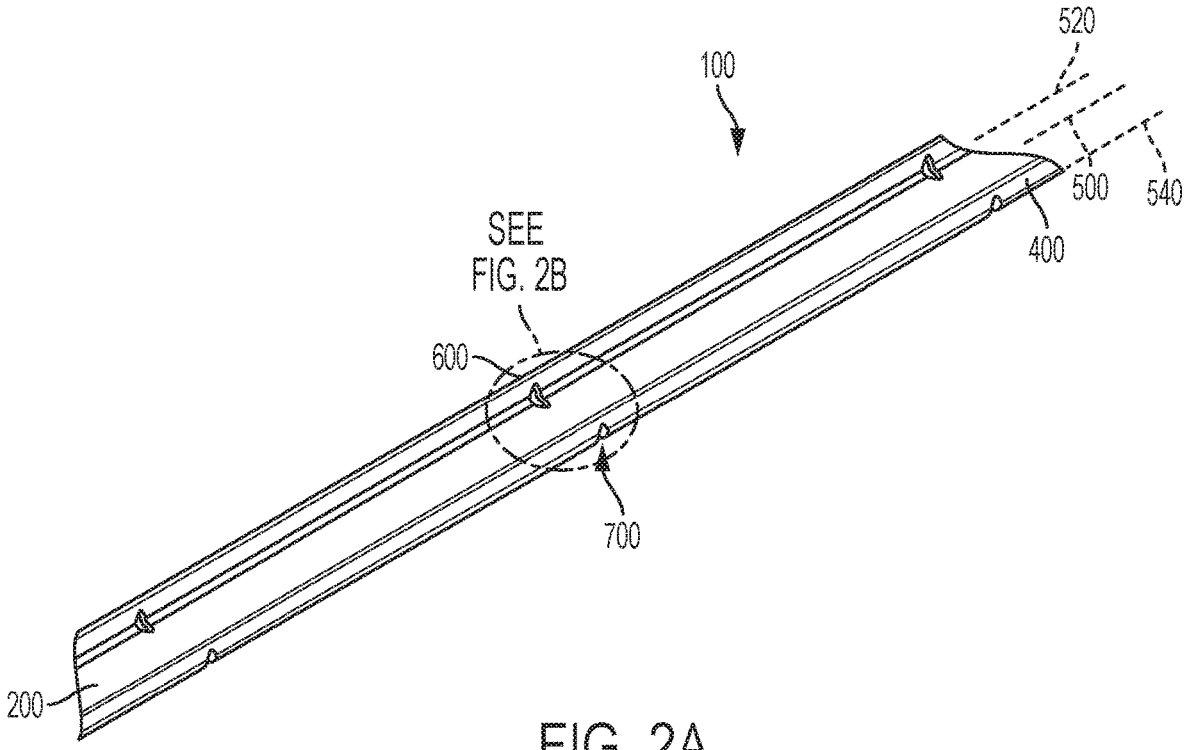
FIG. 2A depicts a perspective inner view of a stud bridge member highlighting the notch set in the circle.

The detail of one notch embodiment is shown beginning with FIG. 2A. FIG. 2A depicts stud bridge member (100) without the stud. As seen, it has the web (200), and the second flange (400). The first flange is also shown, but it is not marked. Also shown are the first juncture line (520), the second juncture line (540) and the longitudinal axis (500). The notch set comprised of first notch (600) and second notch (700) is indicated by the circle referring the reader to FIG. 2B. As indicated, depending upon the length of the stud bridge member, there can be several notch sets. In fact, it may be that not all notch sets are engaged with a stud. For example, there may be notch sets cut every 6 inches, but only every third notch set is engaged if the studs are 18 inches apart.

Figure 2B:
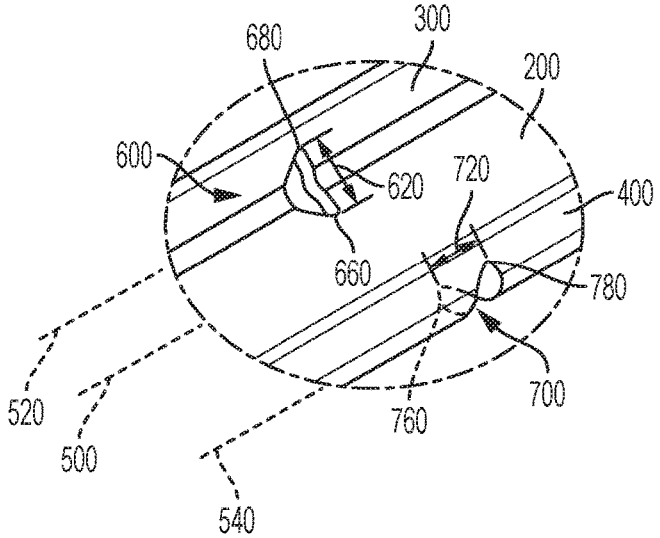
FIG. 2B depicts a close-up perspective inner view of the notch set and the two notches noted in FIG. 2A.

FIG. 2B depicts an inner view of the stud bridge member forming the trough or channel. The web (200), the first flange (300), and the second flange (400) are shown.

In one embodiment, each notch is an opening passing through the outer side to the inner, or channel side, of one of the flanges, the corresponding juncture and the web. The invention is best understood using the preceding notch description.

There are other embodiments. One alternative embodiment comprises a notch which is an opening passing through the outer side to the inner, or channel side, of one of the flanges, through the corresponding juncture and only slightly into the web. Another alternative embodiment is a notch passing through one of the flanges, and the corresponding juncture, but not into the web.

Starting with the first notch (600), the first notch has a first notch length (620). The first notch length is the line running from a reference point called the first flange notch point (680) to the web first notch point (660). In this case, the first notch is an opening starting at the first flange notch point. The first notch runs from the first flange notch point to the web first notch point.

Although not required to be symmetrical with the first notch (600), the second notch (700) can have the same analogous features. The second notch (700) has a second notch length (720). The second notch length is the line running from a reference point called the second flange notch point (780) to the web second notch point (760). In this case, the second notch is an opening starting at the second flange notch point. The second notch runs from the second flange notch point to the web second notch point.

In the case where a notch—either the first notch of the second notch—passes through the juncture, but does not pass into the web, the web notch point is at the web edge where the juncture begins.

Preferably, the notch does not extend across the entire flange. However, in some embodiments, it is possible for a notch to run across the entire flange. In some embodiments, one notch of the notch set may extend across the entire flange, while the other notch does not. In some embodiments, both notches extend across the entirety of their respective flanges. Preferably, both notches do not extend across the entirety of their respective flanges.

Figure 3A:
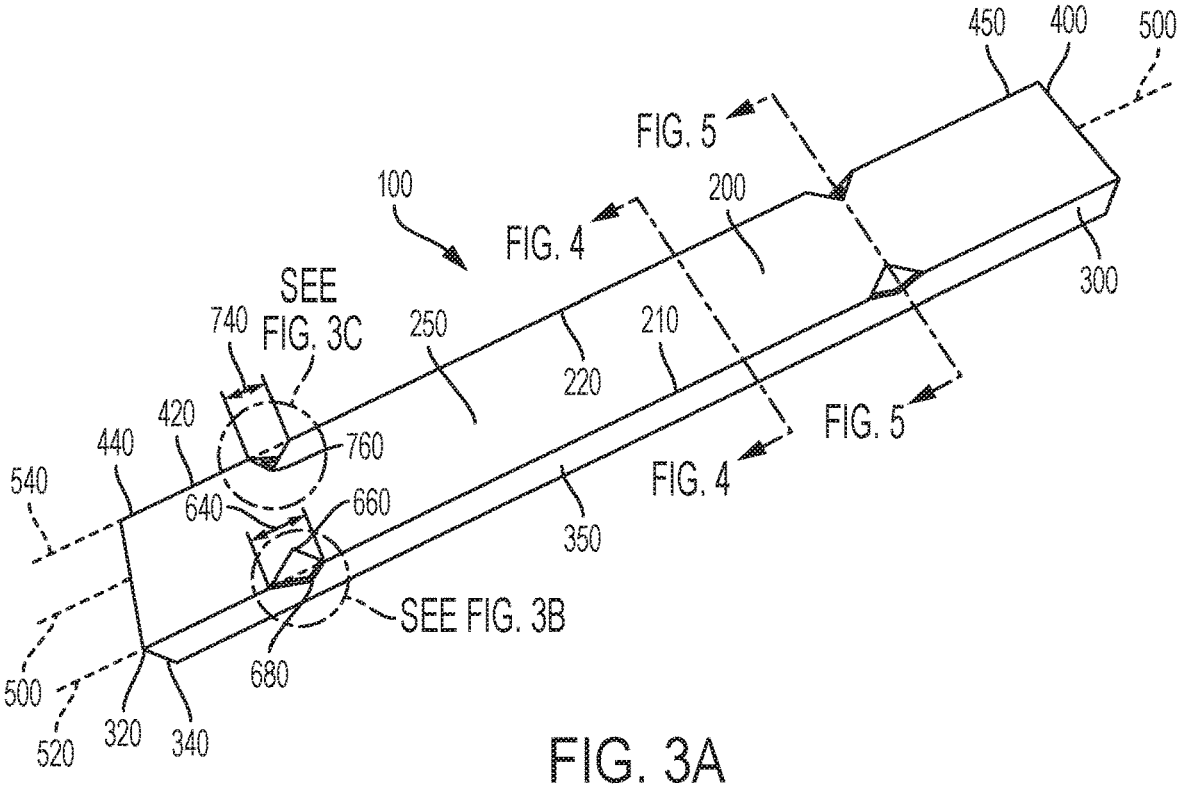
FIG. 3A depicts a perspective outer view of a stud bridge member.

FIG. 3A shows the stud bridge member from the outer channel view, or outer side, where the channel is pointing away from the viewer. As shown in FIG. 3A the web (200) has a web first edge (210) and a web second edge (220) which define a web plane (250). While the term web plane refers to a plane, it does not mean that the web is flat. As an example, the web may contain reinforcing ridges running in any direction, such as perpendicular to the longitudinal axis, or parallel with the longitudinal axis.

FIG. 3A also shows the first flange (300) having two first flange plane edges (320 and 340) defining a first flange plane (350). While the term first flange plane refers to a plane, it does not mean that the first flange is flat. As an example, the first flange may contain reinforcing ridges running in any direction, such as perpendicular to the longitudinal axis, or parallel with the longitudinal axis.

FIG. 3A also shows the second flange (400) having two second flange plane edges (420 and 440) defining a second flange plane (450). While the term second flange plane refers to a plane, it does not mean that the second flange is flat. As an example, the second flange may contain reinforcing ridges running in any direction, such as perpendicular to the longitudinal axis, or parallel with the longitudinal axis.

As can be seen, the first flange plane (350), the web plane (250), and the second flange plane (450) are substantially parallel with the longitudinal axis (500).

Figure 3B:
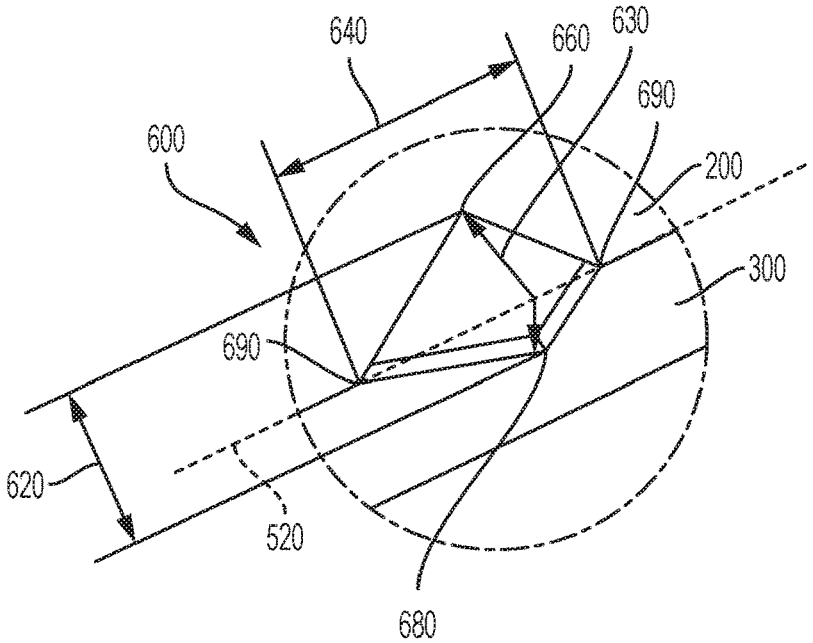
FIG. 3B depicts a close-up perspective outer view of one notch of the notch set noted in FIG. 3A.
Figure 3C:
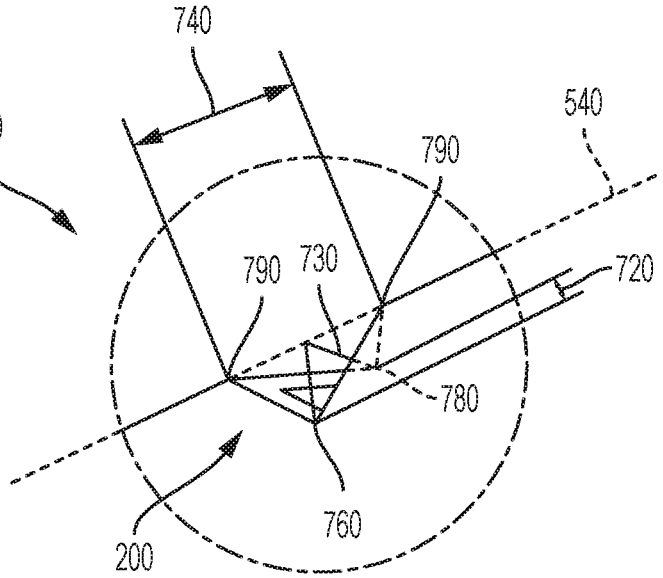
FIG. 3C depicts a close-up perspective outer view of the other notch of the notch set noted in FIG. 3A.

FIG. 3A again highlights the notch set, pointing the viewer to FIG. 3B and FIG. 3C for an expanded view of the first notch (600) and the second notch (700), respectively.

From the outer view, FIG. 3B shows that the first notch (600) has a first notch width (640) which is measured perpendicular to the first notch length (620). The first notch width can be constant along the distance of the notch length or it can have a variable width.

A preferable embodiment is depicted in FIG. 3B, showing a variable notch width increasing as the notch progresses from the first flange notch point (680) across a portion of the first flange (300), across the first juncture line (520), and then decreasing as the notch approaches the web first notch point (660).

The first notch cut plane (630) is defined by a cut made into the web and the first flange if the web and the first flange had been flat, or not bent, when the cut for the first notch was made. After bending, the cut in the web and the first flange form two legs of a triangle, which define the first notch cut plane.

In the current embodiment, there is a first inflection line (690) which is the line perpendicular to the first notch length at which the first notch width (640) is at its greatest value. Because of the rectangular nature of this particular embodiment, the first inflection line coincides with, or is parallel with, the first juncture line (520).

Analogously, FIG. 3C shows the second notch (700) having a second notch width (740) which is measured perpendicular to the second notch length (720). The notch width can be constant along the distance of the notch length or it can have variable widths. A preferable case is depicted in FIG. 3C, showing a variable notch width increasing as the notch progresses from the second flange notch point (780) across a portion of the second flange (400), across the second juncture line (540), and then decreasing as the notch approaches the web second notch point (760).

The second notch cut plane (730) is defined by a cut made into the web and the second flange as if the web and the second flange had been flat, or not bent, when the cut for the second notch was made. After bending, the cut in the web member and the second flange form two legs of a triangle, which define the second notch cut plane.

In the current embodiment, there is a second inflection line (790) which is the line perpendicular to the second notch length at which the second notch width (740) is at its maximum. Because of the rectangular nature of this embodiment, the second inflection line coincides with, or is parallel with, the second juncture line (540).

To facilitate straight positioning of the stud bridge member between the studs, it is preferable that the first notch length (620) and the second notch length (720) not be parallel, but in the same plane.

In a further embodiment the first notch length (620) and the second notch length (720) in a given notch set are perpendicular to the longitudinal axis.

The notches may widen and then shrink to facilitate twisting the member into place and locking it onto the stud. This can be described as the first notch width (640) increasing along the first notch length (620) beginning from the first flange notch point (680) to the first notch inflection line (690) and then decreasing from the first notch inflection line (690) to the web first notch point (660). The notches widen to help account for build variation that occurs during stud to track to building assembly.

Similarly, the second notch width (740) increases along the second notch length (720) beginning from the second flange notch point (780) to the second notch inflection line (790) and then decreases from the second notch inflection line (790) to the web second notch point (760).

The first notch cut plane (630) and the second notch cut plane (730) form what is called the notch plane. The notch plane is also defined by the line connecting the first flange notch point (680) to the web first notch point (660) to the web second notch point (760) to the second flange notch point (780). It is preferable that the line passing from the web first notch point (660) to the web second notch point (760) be perpendicular to the longitudinal axis (500) in order to keep the notches properly aligned with the longitudinal axis.

The notch plane may be perpendicular to, substantially perpendicular to, or not substantially perpendicular to, the longitudinal axis (500).

The only force needed to engage the notches with a stud when the notch plane is substantially perpendicular to the longitudinal axis (500) is a force in the inner direction to engage the notches with a stud.

In contrast, the installer slides the bridge in the longitudinal directional and pushes the bridge member in the inner channel direction to engage the notches with the stud when the notch plane is not substantially perpendicular to the longitudinal axis (500).

The notch sets are parallel when a plurality of notch sets is present on the bridge member.

It is also preferable that the notch points in the flange edges, i.e. the first flange notch point and the second flange notch point, are equidistant from the longitudinal axis.

However, in an alternative embodiment, the notch points in the flange edges, i.e. the first flange notch point and the second flange notch point, may not be equidistant from the longitudinal axis.

In one embodiment both notches in the notch set are symmetrical, i.e. the same geometric shape. In an alternative embodiment, the notches in the notch set are not symmetrical.

FIG. 4 is a cutaway view as depicted in FIG. 3A. Shown in FIG. 4 are a web outer side (240), and a web inner side or channel side (260) which is opposite of the web outer side. As further seen, one of the first flange edges (320) is joined with the web first edge (210). As shown, this joining is done at a first juncture (510) having a first juncture outside angle ($\Theta_{M1}$) measured from the web outer side (240) to the outer side of the first flange (300).

The value of $\Theta_{M1}$ is preferably greater than 270° and less than 360°. If $\Theta_{M1}$ is less than 270° the stud bridge member is difficult to rotate onto the walls of the stud hole.

As a corollary, there will be an explementary angle $\alpha_{M1}$, which is the value of the angle opposing angle $\Theta_{M1}$. $\Theta_{M1}$ plus $\alpha_{M1}$ will equal 360°.

The first juncture (510) of the stud bridge member forms a first juncture line (520) which is substantially parallel to the longitudinal axis (500).

The similar structure is true of the second flange. As with the first flange, one of the second flange edges (420) is joined with the web second edge (220) at a second juncture (530) having a second juncture outside angle ($\Theta_{M2}$).

Like $\Theta_{M1}$, $\Theta_{M2}$ is measured from the web outer side (240), i.e. the non-channel side, to the outer side of the second flange (400) as shown in FIG. 4. The value of $\Theta_{M2}$ is preferably greater than 270° and less than 360°. If $\Theta_{M2}$ is less than 270° the stud bridge member will be difficult to rotate onto the walls of the stud hole.

As a corollary there will be an explementary angle $\alpha_{M2}$ which is the measurement of the angle opposing angle $\Theta_{M2}$. $\Theta_{M2}$ plus $\alpha_{M2}$ will equal 360°.

It is preferred that $\Theta_{M1}=\Theta_{M2}$, although not required. Put another way, $\Theta_{M1}$ and $\Theta_{M2}$ have about the same value, or preferably are the same value.

The second juncture forms a second juncture line (540) which is substantially parallel to the longitudinal axis (500).

To define the C shape, or channel, as opposed to a Z, the first flange (300) and the second flange (400) must simultaneously be in a space on the web inner side (260).

Figure 5:
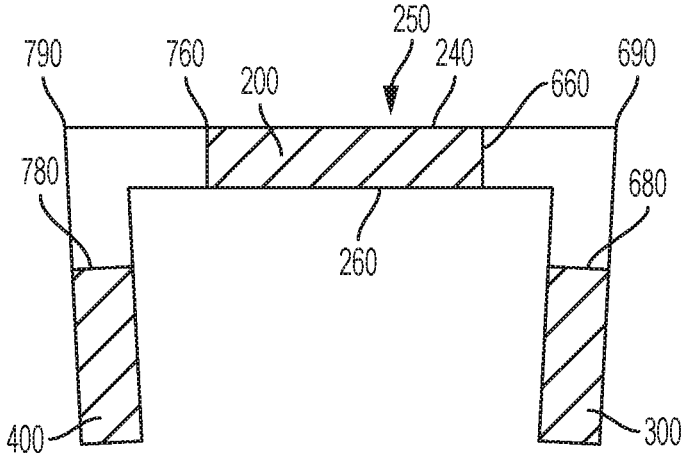
FIG. 5 is a cut-a-way center view at the point noted in FIG. 3A.

FIG. 5 is a cutaway view of the stud bridge member (100). It depicts the first flange (300), the second flange (400), the web (200) having a web outer side (240) and a web inner side (260). The web first notch point (660), the first flange notch point (680) and the first inflection line (690) are also shown. The web second notch point (760), the second flange notch point (780) and the second inflection line (790) are shown as well.

One way to make the bridge member is to cut the notches into a flat piece of metal and then fold the flat piece of metal into the web with a flange on each side. This is depicted in FIG. 6A to FIG. 6E. When metal is flat, the notch has a distinct shape.

One preferred shape is an elongated rectangle, preferably an elongated square. This is depicted in FIG. 6B. The notch shape would appear flat as a diamond with elongated tips at the flange notch points. This elongated flaring from the flange notch point or necking down as the cut approaches the flange notch point, helps improve the engagement of the notch with the stud. This elongated flaring or necking down to a pinch point in the flange also creates a lead-in for the stud member to aid in the assembly process.

FIG. 6A to FIG. 6E show alternative embodiments of the notches in the notch set. These embodiments demonstrate how the part of the notch in the flange has a pinch point, but that the part of the notch in the web should be minimized. To be minimized means that the maximum distance from the cut(s) in the web measured from any point along the cut in the web, perpendicular to the longitudinal axis to the juncture is less than about 10% of the width of the web, preferably less than 5% of the width of the web, with less than 1% of the width of web even more preferred. It is even possible that the notch is not cut into the web at all, but only through the juncture. The notch's radius into the web is preferably large while the notch width and length in the web should be smaller. The notch should be sharp in the flange, but well-rounded in the web In FIG. 6A, the un-stretched square oriented as a diamond is shown.

FIG. 6B shows the stretched rectangle, or stretched diamond. This is a preferable embodiment so that the stud wall can be pinched by the part of the notch in the flange. The notch edge lines do not have to be straight but can be curved as indicated.

Figure 6A:
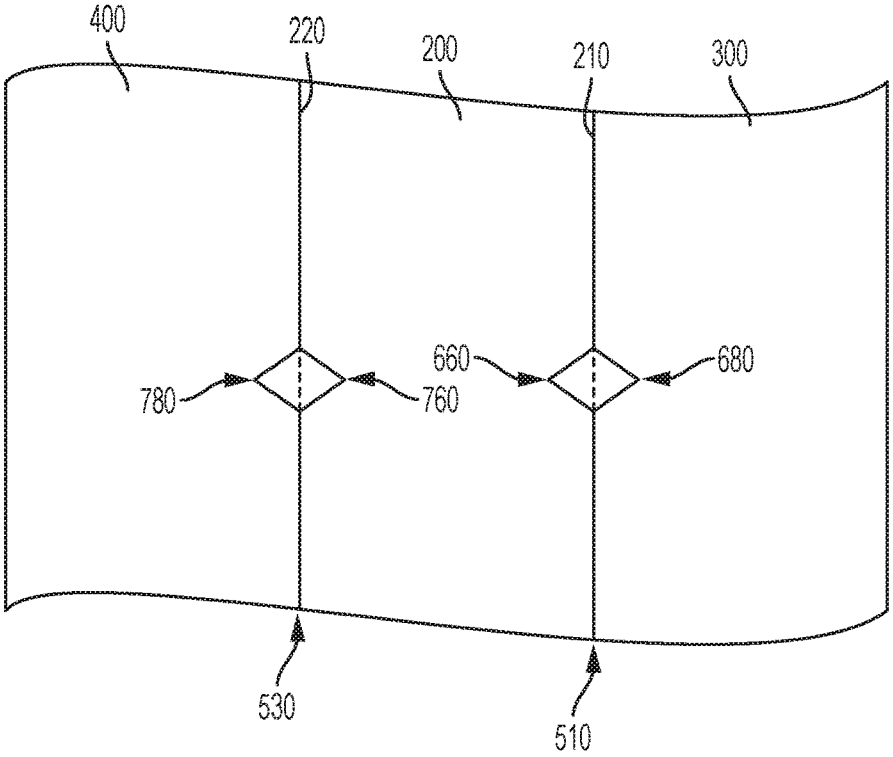
FIG. 6A is an embodiment of the notches of a notch set.
Figure 6B:
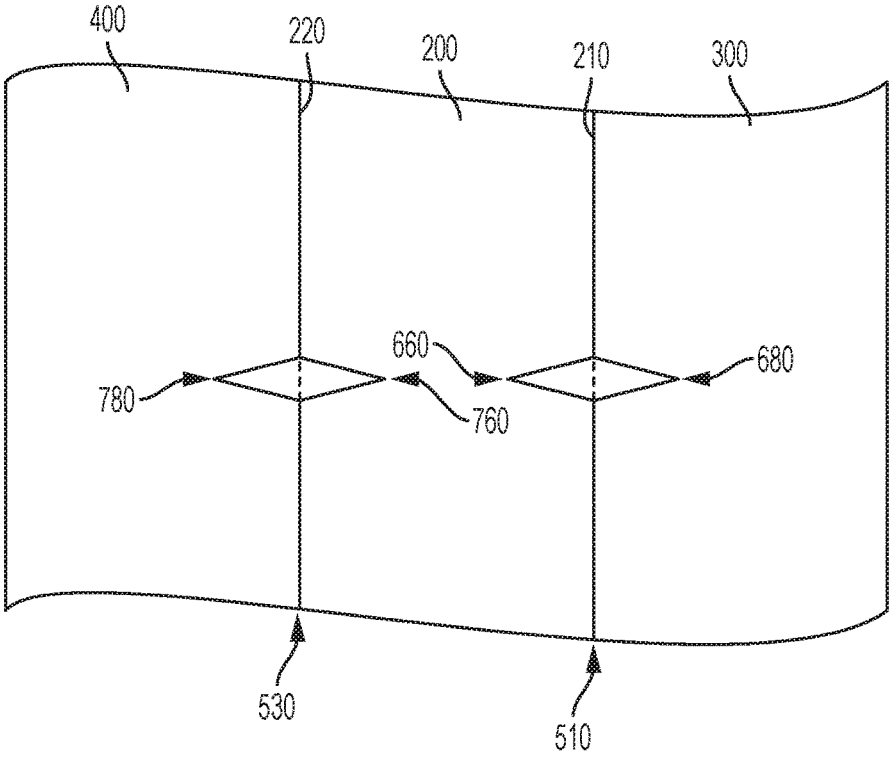
FIG. 6B is a separate embodiment of the notches of a notch set.
Figure 6C:
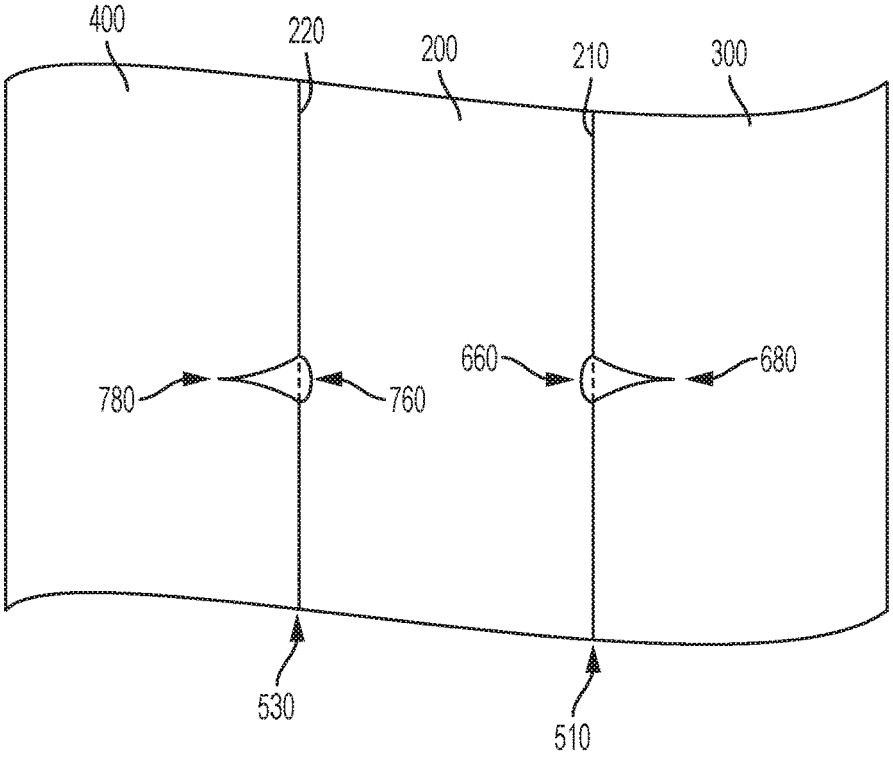
FIG. 6C is a separate embodiment of the notches of a notch set.

In FIG. 6C, the embodiment of substantially forming a triangle is shown with the two sides of the notch tapering to a point in the flange side, and extending past the inflection point, through about the juncture and about, or optionally slightly into the web. While the drawing shows the part of the triangle in the web being a curve, that part of the notch line can be straight, zig-zagged, or two lines, provided that the maximum distance into the web is less than one of the preferred amounts noted above. The lines do not have to be straight but can be curved as indicated. In fact, the web first notch point (660) and web second notch point (760) can be immediately after the juncture at the respective web edge (210 and 220). Again, the notch's radius into the web is preferably large while the notch width and length in the web should be smaller. The notch should preferably be sharp in the flange, but well-rounded in the web.

Figure 6D:
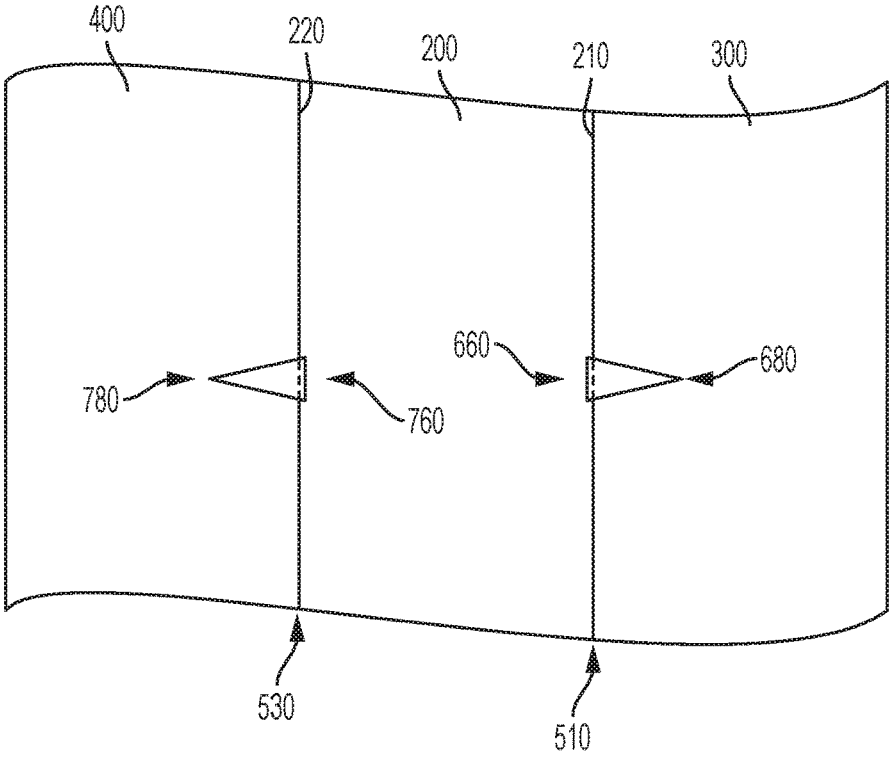
FIG. 6D is a separate embodiment of the notches of a notch set.

FIG. 6D shows the embodiment where the notch cuts through the juncture but does not enter the web. In fact, the web first notch point (660) and web second notch point (760) are in between the juncture and the respective web edge (210 and 220).

Figure 6E:
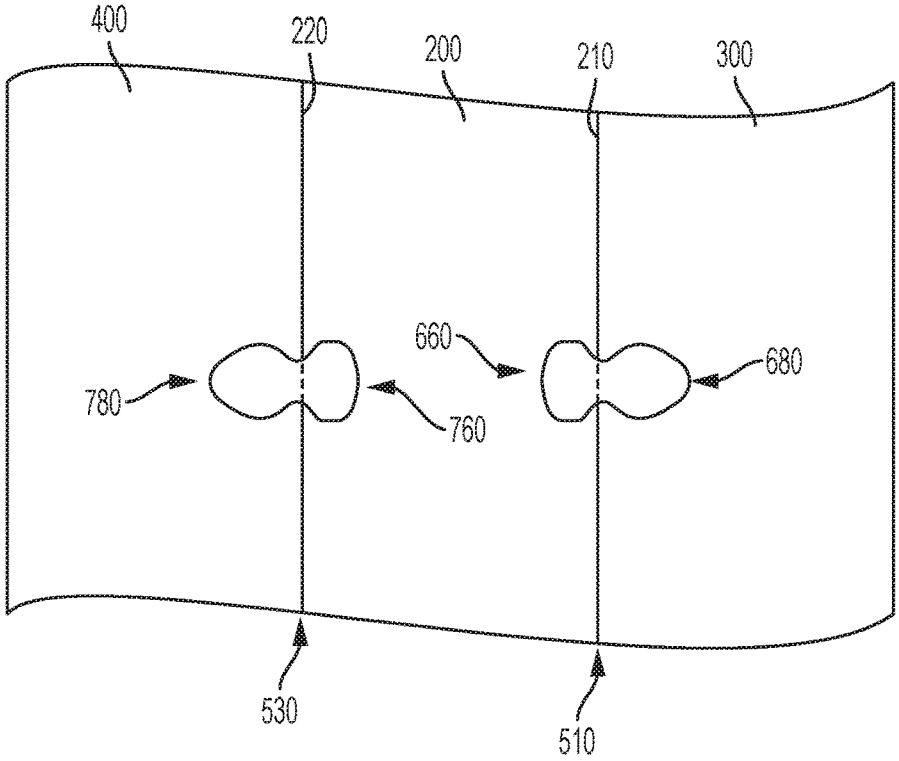
FIG. 6E is a separate embodiment of the notches of a notch set.

FIG. 6E is another embodiment of a notch set. The notches in this notch set are different from the others as they have an hourglass shape forming a narrow pinch point at the juncture of the flange and the web. FIG. 6E should be viewed in light of FIG. 8A.

Figure 7:
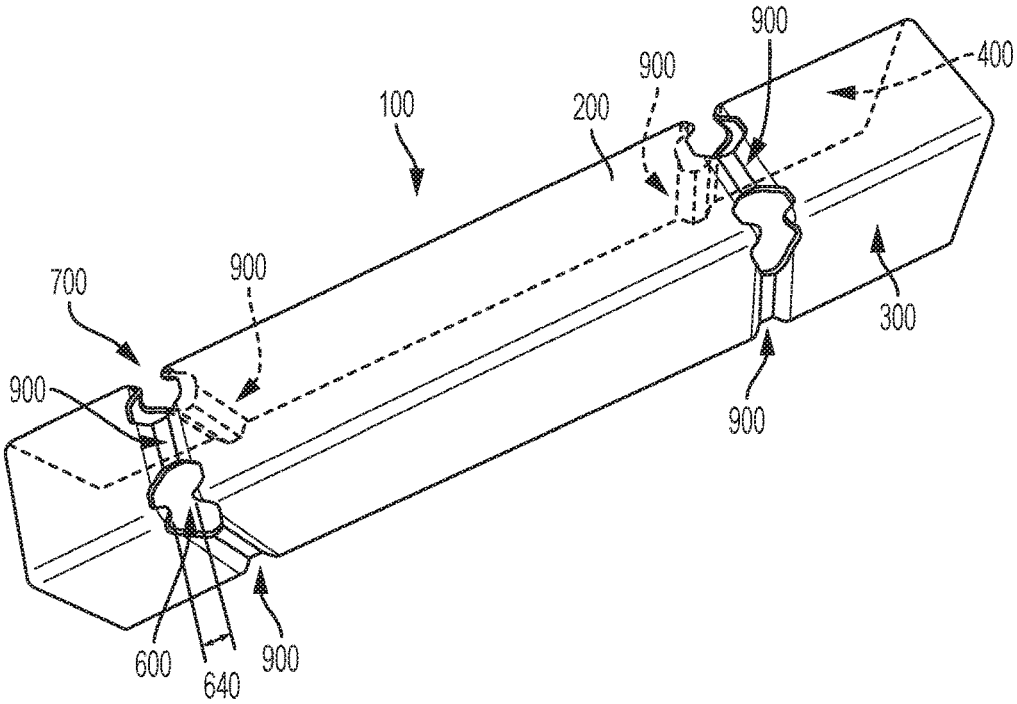
FIG. 7 is a separate embodiment of a gusseted bridge member.
Figure 8A:
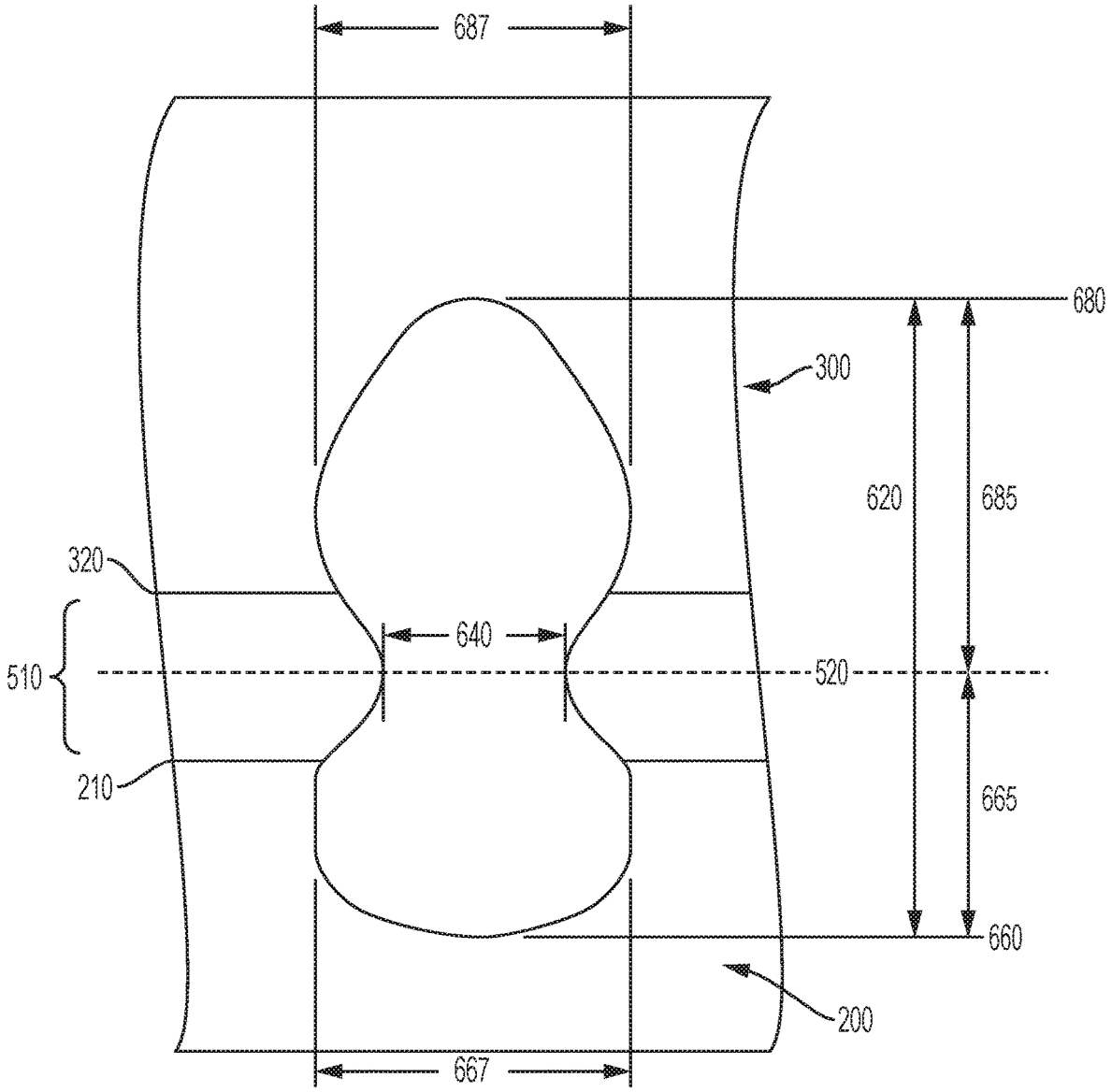
FIG. 8A is an enlarged view of one notch of the notch set depicted in FIG. 6E.
Figure 8B:
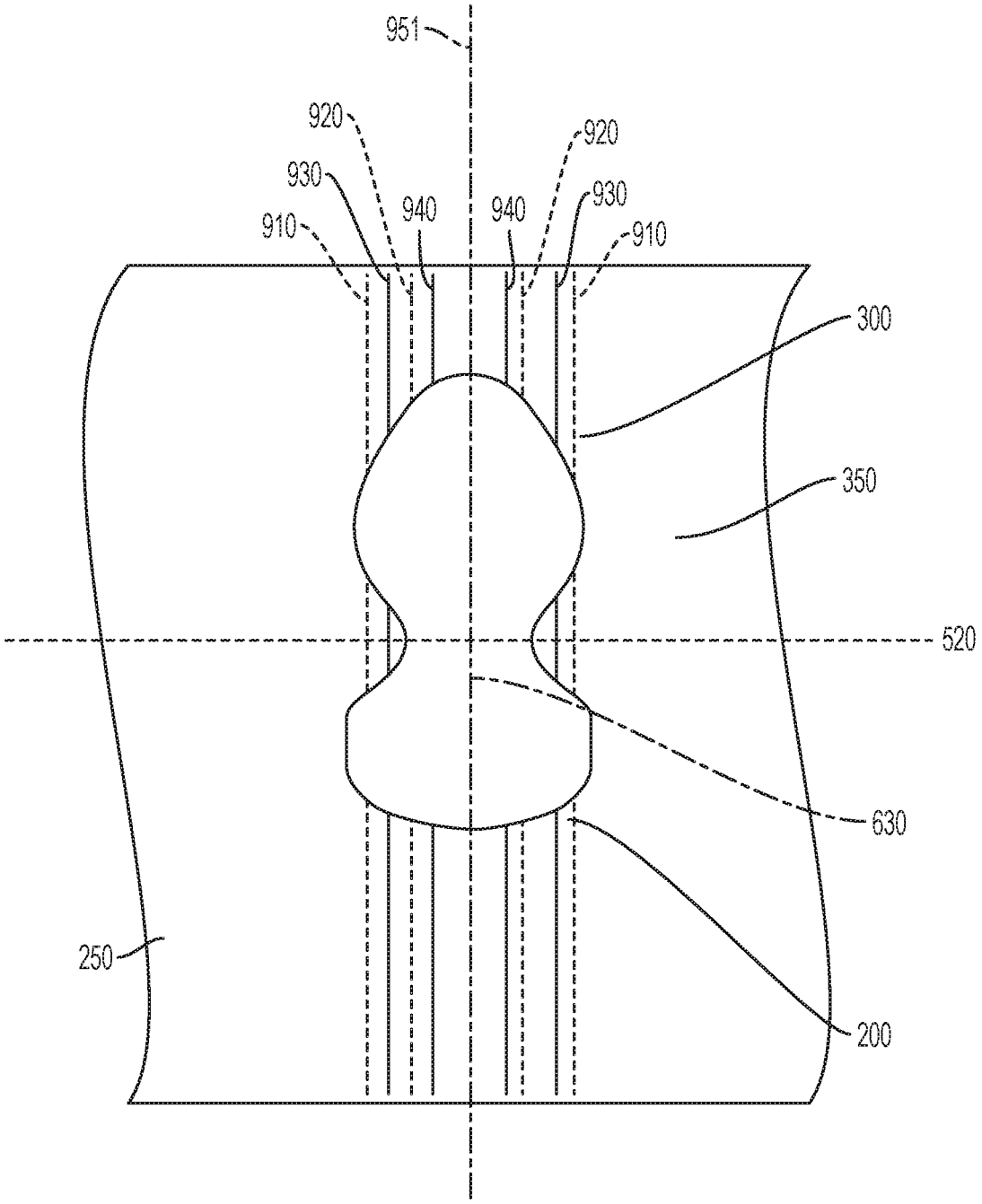
FIG. 8B is an enlarged view of one notch of the notch set depicted in FIG. 6E as cut at the gusset.

FIG. 7, which should be viewed in light of FIG. 8B, is a different embodiment of the stud bridge member (100) with web (200) and flange (300) facing front and flange (400) on the back. A notch set is shown on the left side of the bridge member. The notch set has two notches (600 and 700) as configured in FIG. 6E. (640) shows the notch width. In this embodiment there is a gusset (900) on at least one flange. In the embodiment shown in FIG. 7, the gusset runs from the first flange edge of the first flange (300) to the web, across the web and then from the web to the second flange edge of the second flange (400).

Referring to FIG. 8B, the first notch flange length (685) is the length of the notch into the flange measured from the middle of the notch width (640) at the juncture line (520) to the first flange notch point (680). The notch flange length aligns with the line of the gusset, or gusset line (951).

There may be only one gusset on one flange. The gusset preferably runs from the flange end to the respective flange notch point. There may be a gusset on each flange and no gusset on the web. There may be a gusset on each flange and the web.

Accordingly, it can be described that the bridge member has at least one gusset that extends from the first flange second edge to at least the first flange notch point or from the second flange second edge to at least the second flange notch point.

The gusset may extend from a flange second edge through the notch to the web and then across at least portion of the web.

Accordingly, it can be described that the bridge member has a gusset extending from the first flange second edge to the first flange notch point and the second flange second edge to the second flange notch point.

Accordingly, it can be described that the bridge member has a gusset extending from the first flange second edge to the first flange notch point and the second flange second edge to the second flange notch point and extending across at least a portion of the web on a line between the web first notch point and the web second notch point.

As shown in the embodiment of FIG. 7, the gusset (900) may extend across the web passing from the first web notch point to the second web notch point as shown in FIG. 6E. The gusset may then extend to the second edge of other flange, i.e. the second flange second edge.

The width of the gusset to the width of the notch(es) is not so important. The gusset can be wider than the notch or the notch can be wider than the gusset.

However, both the notch width and gusset width are governed by the material thickness of the stud. Accordingly, both the notch width and the gusset width have to be wider than the stud material thickness.

FIG. 8A depicts a notch of the notch set of FIG. 6E. This hourglass notch has notch length (620) which is measured when the notch is cut into the flat metal before the metal is bent into shape. As can be seen this embodiment has different widths and lengths in the flange and web. First, there is the notch width (640) measured at the juncture line (520). (667) refers to the maximum notch width in the web, with (665) referring to the notch length in the web measured from (520) at the middle of the notch width (640). (687) refers to the maximum notch width in the flange, with (685) referring to the notch length in the flange. (620) refers to the first notch length which is the total length of the notch if laid out without the bend between the web and flange. The first notch length (620) is also the sum of the notch web length (665) and the notch flange length (685) regardless of a bend as the web and flange notch lengths remain constant during bending.

Notch width 667 is needed for a lead-in for assembling the bridging member with the stud as the bridging member is twisted in the stud hole. Accordingly notch width 667 can be much wider than flange width 687. Notch width 640 needs to be narrower than 667 and the radius of the arc at 680 is smaller than the radius of the arc at 660 to taper and lock the CRC bridging member into the stud slot at 640 and 680. Thus, 640 is preferably a much smaller width than 667. In a preferred embodiment of the installation, the stud does not engage the notch in the web at 667, but the stud engages and locks with the notch at 640 and at 680

While FIG. 8A refers to and describes the first notch, the second notch may be of similar or identical configurations.

The notch embodiment in FIG. 8A, having a waist, i.e. a wide spot in the flange, a thinner pinch point at the juncture and again a wide spot in the web, may be compared to the notch embodiment in FIG. 6A which has no waist.

For the embodiment in FIG. 6A, the maximum notch width in the web can be less than, equal to, or greater than the notch width (640) measured at the juncture line. For example, the embodiment in FIG. 6A shows a diamond for a notch placing the same triangle into the flange and web.

For the embodiment in FIG. 6A, the maximum notch width in the web will be slightly less than or equal to the notch width measured at the juncture line, which corresponds also to (520). But it is not greater than the notch width (640). Therefore it can said to be less than the notch width (640).

For the embodiment in FIG. 6A, the relationship of the flange notch width to the notch width at the juncture line is the same as the relationship of the web notch width. The maximum flange notch width will always be just slightly less than that notch width (640).

While FIG. 8A refers to and describes the first notch, the second notch may be of similar or identical configurations. FIG. 6D is an embodiment where the maximum notch width in the web is greater than notch width (640) at the juncture and which are both greater than the maximum notch width in the flange.

FIG. 8B shows a top view of the notch cut along the gusset before the metal is bent at (520). The dashed lines represent the gusset configuration on the back side opposing the page side which is the inside of the channel when bent as indicated by (250) and (350). The solid lines are the gusset lines as indicated in the outside view.

(630) depicts the notch cut length of the first notch, when the bridge member is bent as in FIG. 3B and in conjunction with the second notch cut length (730) of the second notch defines the notch cut plane.

Figure 9A:
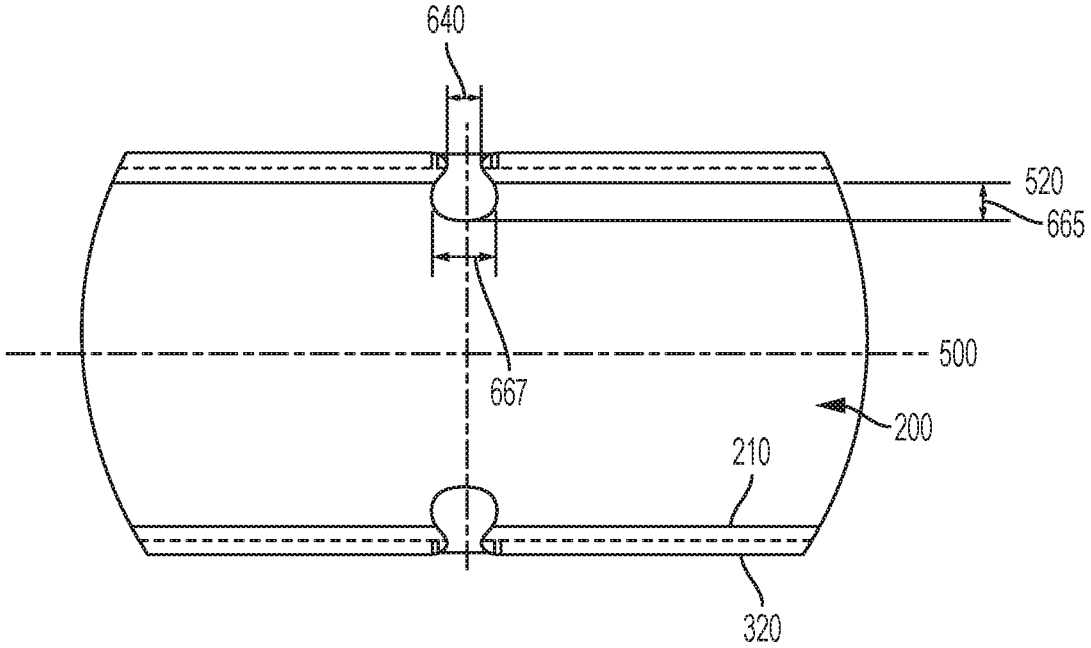
FIG. 9A is a view looking at the outside web of a gusseted embodiment of the invention.
Figure 9B:
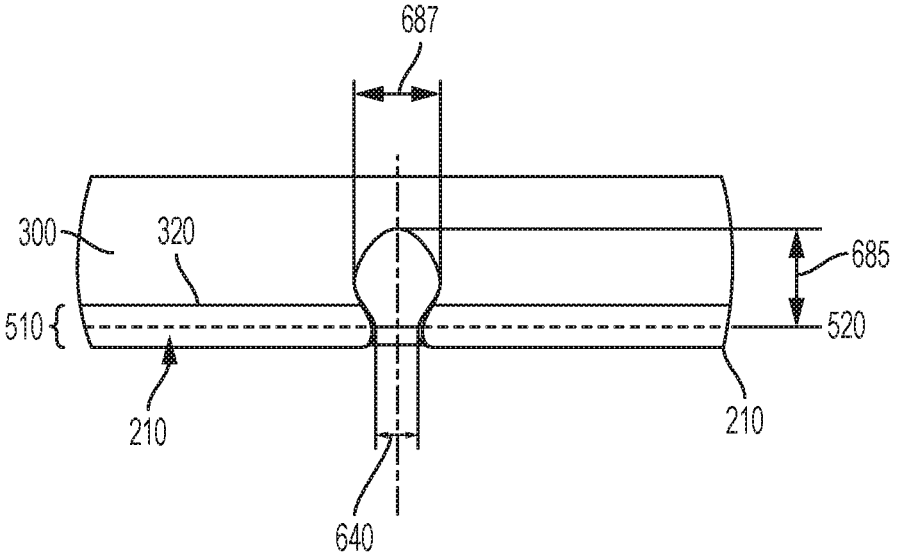
FIG. 9B is a view of a gusseted embodiment looking at the first flange (300).
Figure 10A:
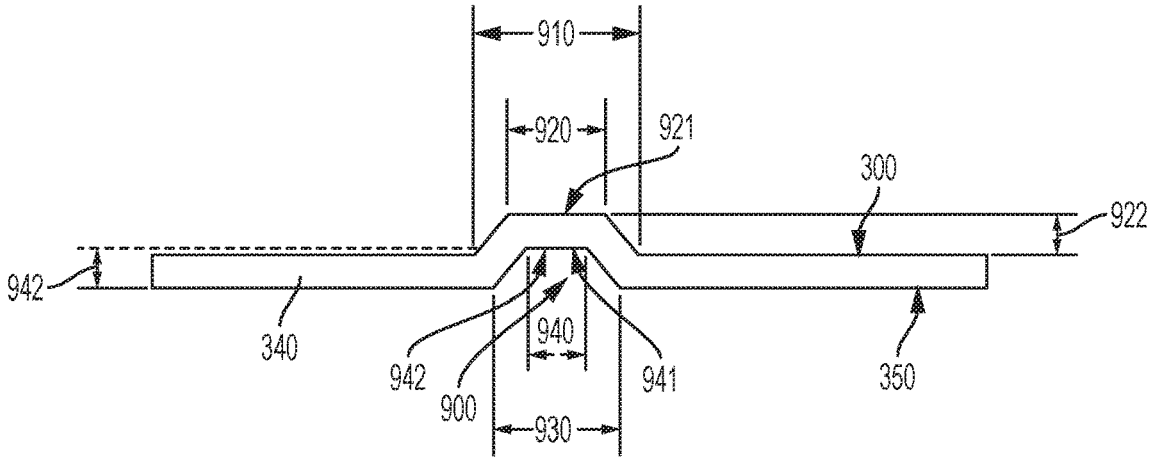
FIG. 10A is a view of a flange edge with the gusset.

FIG. 9A and FIG. 9B are web views and flange views of the bridge member without the gusset. All elements have been identified previously FIG. 10A is a view of the second edge of the first flange (300) parallel to the longitudinal axis. As can be seen, this embodiment of the gusset is half of a hexagon (six sided figure).

(921) depicts the inner apex of the gusset or the point of the gusset line which is the furthest from the inside of the flange sticking into the channel formed by the two flanges and the web. Corresponding to (921) is (941) which is the outer apex of the gusset on the opposite side of the flange. (922) is the gusset inner depth which is at the inner apex (921) and (942) is the outer depth of the gusset from the outer side of the flange (350) at the gusset outer apex (941). (941) is the point in the gusset on the outside of the bridge member furthest away from the outer side of the flange (i.e. the apex).

(910) depicts the gusset major inner width of the gusset which occurs on the web side of the flange in this case. (920) depicts the gusset minor inner width of this embodiment. (930) depicts the gusset major outer width of this embodiment. 940 depicts the gusset minor outer width of this embodiment. The phrase inner and outer refer to the side of the flange or web relative to the channel formed by the two flanges and the web with the inner referring to channel side and outer referring to the non-channel side.

While this gusset embodiment is a half a hexagon, the gusset can be curved, or v-shaped, or square shaped, or rectangular shaped or other geometric configurations forming a small indentation into the flange at the notch. This gusset embodiment can be formed on a roll form mill or a press brake and shear machine.

Figure 10B:
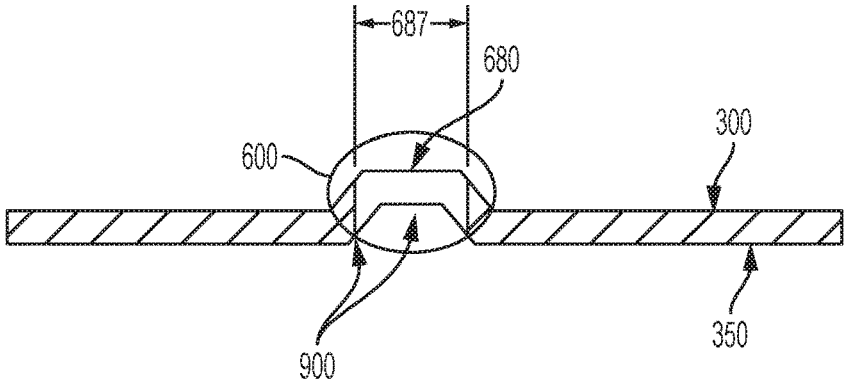
FIG. 10B is a cutaway view of flange at the gusset where the wide part of the notch is cut.
Figure 10C:
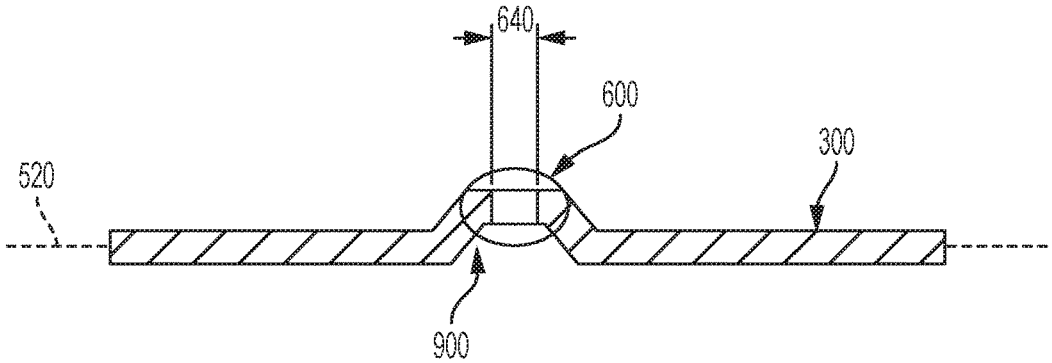
FIG. 10C is a cutaway view of flange at the gusset where the narrow part of the notch is cut.

FIGS. 10B and 10C are cutaways of the flange (300) parallel the longitudinal axis at various points in the notch.

FIG. 10B depicts the gusseted flange of FIG. 10A cutaway at the notch (600) at the notch flange width (687). FIG. 10B also shows (680), the flange notch point, which is the point where the notch of this embodiment starts in the flange and comes to the notch web width. In FIG. 10B, the flange notch point is in a plane behind the plane of the notch flange width. The two arrows of (900) are to indicate that the whole indentation is part of the gusset (900).

FIG. 10C is the gusset (900) at line 520, which corresponds to the notch width (640) at line (520). While FIGS. 10A to 10C refer to and describe the first flange, the second flange may be of similar or identical configurations.

Figure 11A:
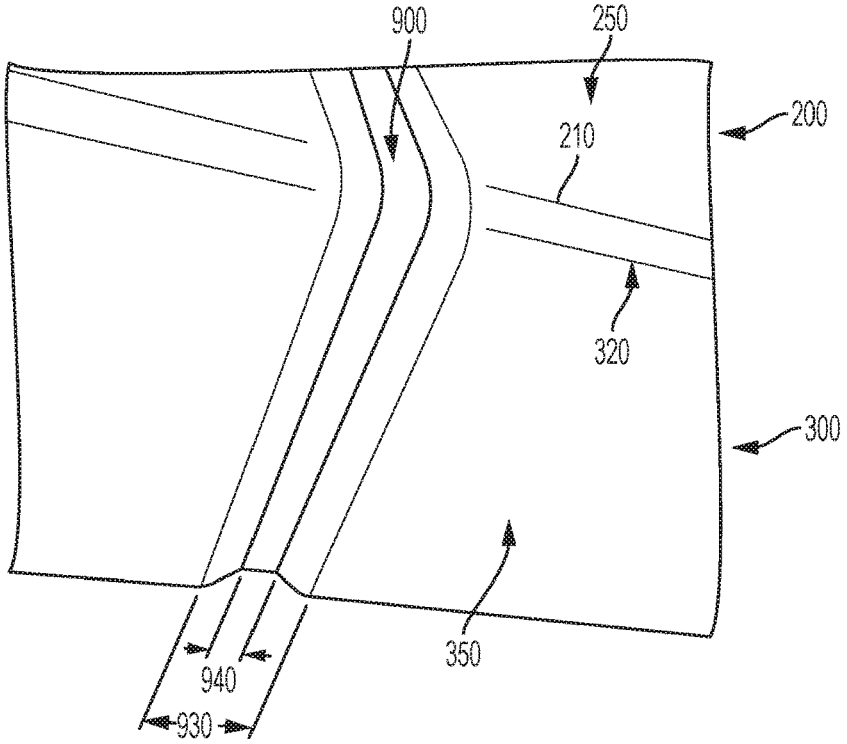
FIG. 11A depict a gusseted bridge member at the juncture of the web and flange without the notch.

FIG. 11A depicts the channel of the bridge member with the gusset but without the notches. The unbent piece of metal is what has the notches cut as shown in FIG. 8B and then has the gusset stamped into it. The reverse order is also possible.

Figure 11B:
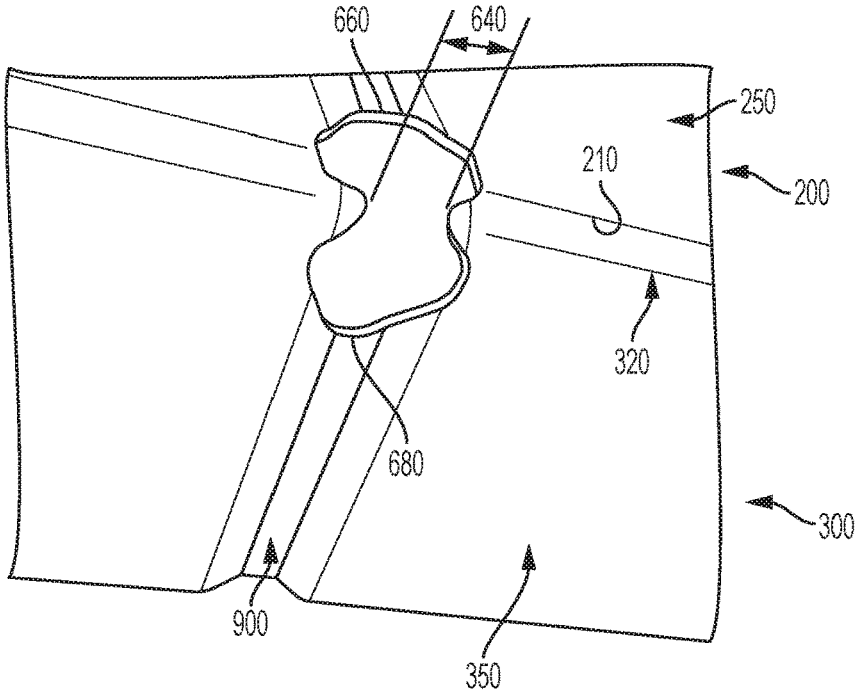
FIG. 11B depicts a gusseted bridge member at the juncture of the web and flange with the notch.

FIG. 11B is the same part as FIG. 11A, but with the notch, in this case notch (600).

As explained previously, the embodiment without the gusset cannot be inserted into the stud hole and then set into place unless the flange is bent into the channel, i.e. the inner angle ($\alpha_{M1}$ and/or $\alpha_{M2}$) between the web and the un-gusseted flange is less than or equal to 90° as shown in FIG. 4. A drawback to this embodiment is that the bridge members cannot be nested into each other and a bridge clip is required.

However, as explained below, because the gusset allows for more room at the actual vertical framing component hole, which is a stud hole when the vertical metal framing component is a stud, the flanges can be bent outwards on the embodiment with the gusset.

Having the flanges bend outwards allows one bridge member to nest in another bridge member, thus eliminating the use of bridge clips except for the ends of the first and last bridge member.

Additionally, having the flanges of the gusseted bridge members bend outwards towards the edges of the stud hole provides for even further support of the stud by the bridge member. This is shown in FIG. 12A and FIG. 13.

Figure 12A:
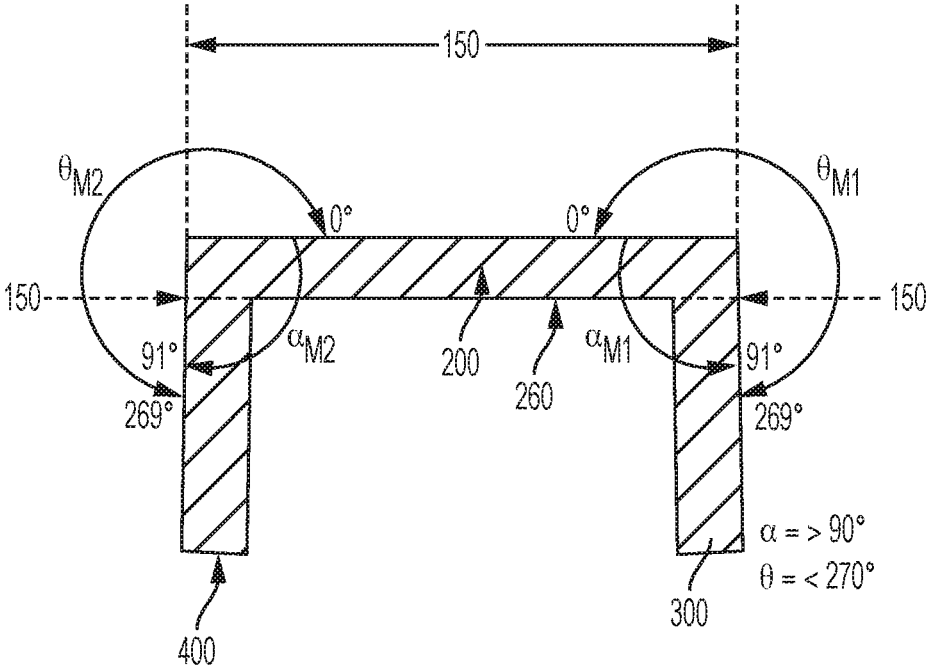
FIG. 12A is a cutaway of the gusseted bridge member perpendicular to its longitudinal axis not at the gusset.
Figure 13:
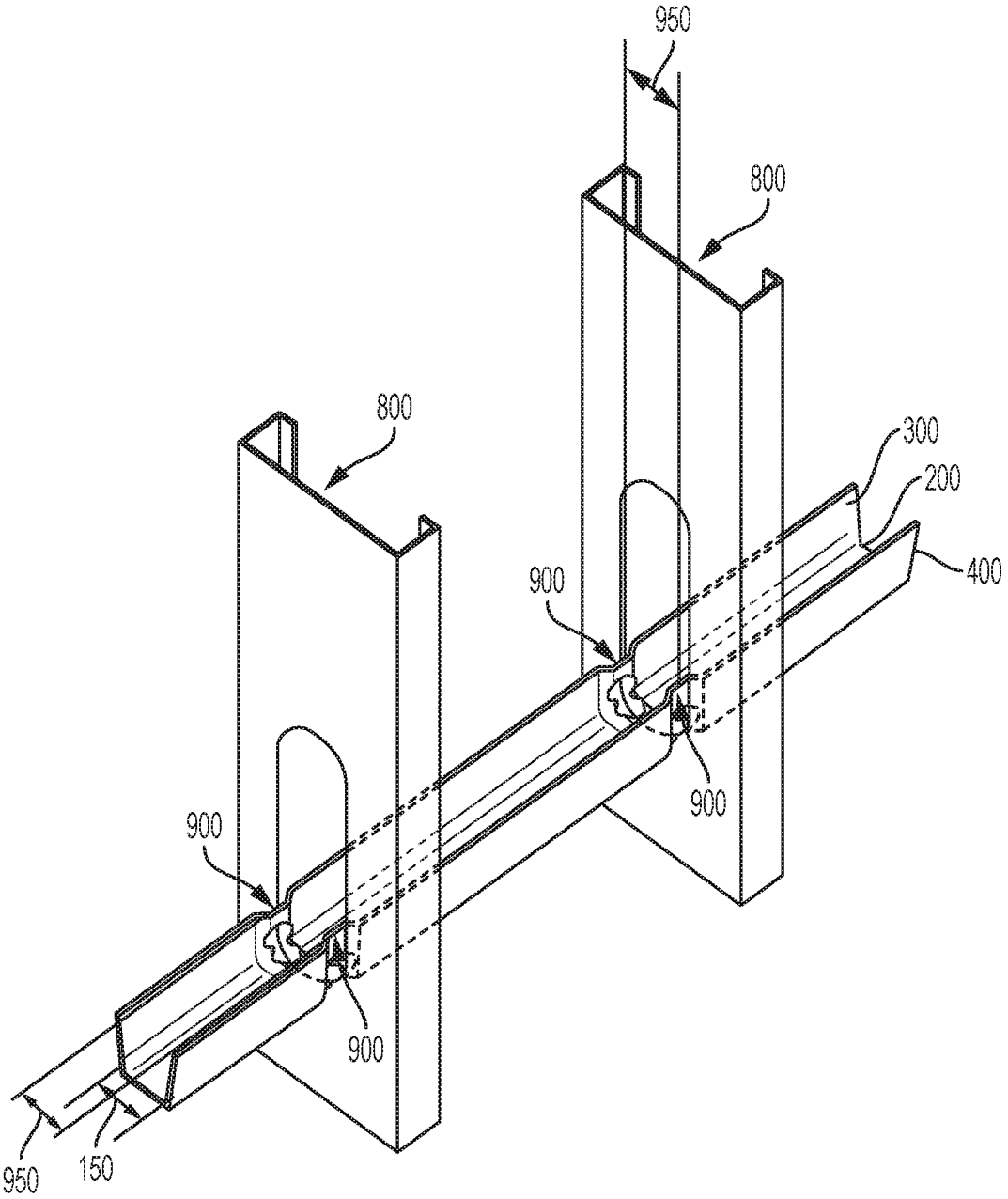
FIG. 13 depicts an embodiment of the gusseted bridge member installed between two vertical metal framing components which in this embodiment are studs.

FIG. 12A is a cutaway of the gusseted bridge member with outwardly bent flanges. This cutaway is perpendicular to the longitudinal axis (500) showing the angles of the flanges. The gusset is not in shown in FIG. 12A, because the cutaway is not at the gusset.

Figure 12B:
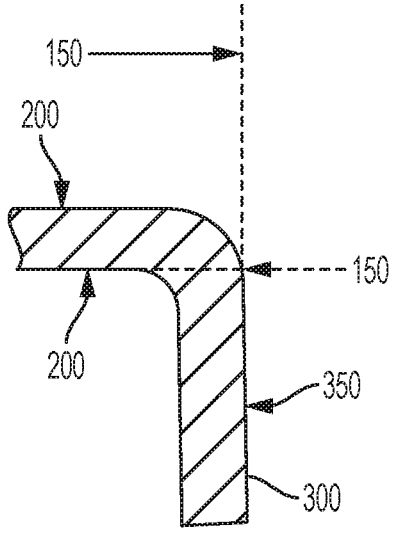
FIG. 12B depicts where to measure the gusseted bridge member width.

FIG. 12A also denotes the stud bridge member width (150). The bridge member width is the width of the bridge measured at the inner side of the web perpendicular to the longitudinal axis. The measurement is done at the inner side of the web to account for the fact that when a straight piece is bent, the outside configuration is rounded and not an exact right angle until the curve ends. This concept is shown in FIG. 12B.

As shown in FIG. 12A the embodiment with the gusset preferably has an inner angle ($\alpha_{M1}$ and/or $\alpha_{M2}$) from the web to the gusseted flange, measured after the curve and not measured at the gusset, which may be greater than or equal to 90°, with the corresponding explementary inner angle ($\theta_{M1}$ or $\theta_{M2}$) being less than or equal to 270°.

While the maximum angle for each flange of the bridge member can be calculated, an easier way to understand this is to realize that the length of a line perpendicular to the longitudinal axis (500) running from the outside of the gusset at the flange edge (gusset outer apex (941)) to the outside of the opposing flange second edge is preferably less than or equal to the stud hole depth (820), or more preferably, less than or equal to the stud bridge member width (150).

If the opposing flange has a gusset, then the length of the line is the length of a line perpendicular to the longitudinal axis (500) running from the outside of the gusset at the flange second edge (the second flange's outer apex) to the outside of the gusset on the opposing flange second edge.

For example, the standard stud has a hole depth of 1.5"+/−0.01". Thus, the hole depth could be as small as 1.49". The distance between the gusset apex on flange (300) and the gusset apex on flange (400), measured perpendicular to the longitudinal axis must be less than or equal to 1.49". In the case where only one flange has a gusset, the maximum distance between the flange second edges is again measured along the line perpendicular to the longitudinal axis from the outer apex of the single gusset to the outer side of the opposing flange second edge.

This is typically accomplished with an inner angle of from greater than 90° to less than about 110°, with 100° being preferred. In this case both $\alpha_{M1}$ and $\alpha_{M2}$ would have a value of greater than 90° and less than about 110°. However, experience has shown that an inner angle of about 100°+/−1° of standard manufacturing variance is preferred in order for the gussets to nest within each other and eliminate the use of bridge clips except for the un-nested ends of the first and last bridge member.

FIG. 13 is an embodiment of the gusseted bridge member installed with its notches interacting with stud at the stud hole. The installer inserts the bridge member into the stud hole with the bridge width being substantially parallel with the stud hole length (830) as shown in FIG. 1, aligning the gusset with the edges of the stud hole and twisting the bridge member so that the bridge member width is substantially perpendicular to the vertical metal framing component hole length, which in the figures are a stud hole length, and pushing the bridge member down to engage the edges of the vertical metal framing component hole which is the stud hole (810 as shown in FIG. 1) with the notches as shown in FIG. 13.

FIG. 13 and FIG. 1 also show that the distance between the outer gusset apex and the opposing flange when measured perpendicular to the longitudinal axis and parallel with the web is less than or equal to the bridge member width. In the embodiment shown there are two gussets, one the flange and the other on the opposing flange.

Figure 14A:
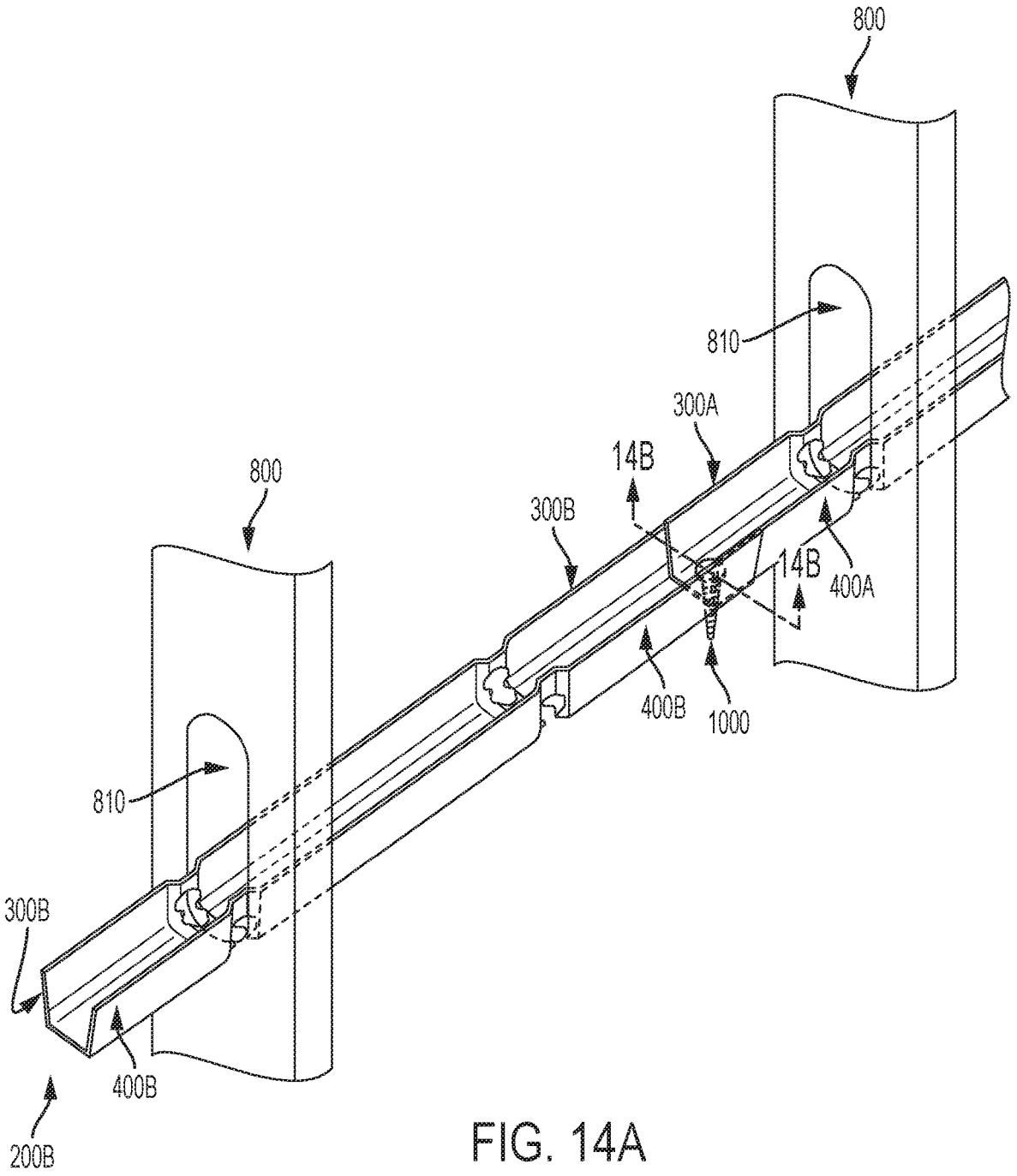
FIG. 14A depicts an embodiment of nested bridge members in a vertical metal framing component which in this embodiment is a stud.

FIG. 14A shows the embodiment of two gusseted bridge members A and B nested into each other. 300A, 200A, and 400A are the respective first flange, web and second flange of the inside bridge member nested into the inside of the bridge member of 300B, 200B, and 200A.

Figure 14B:
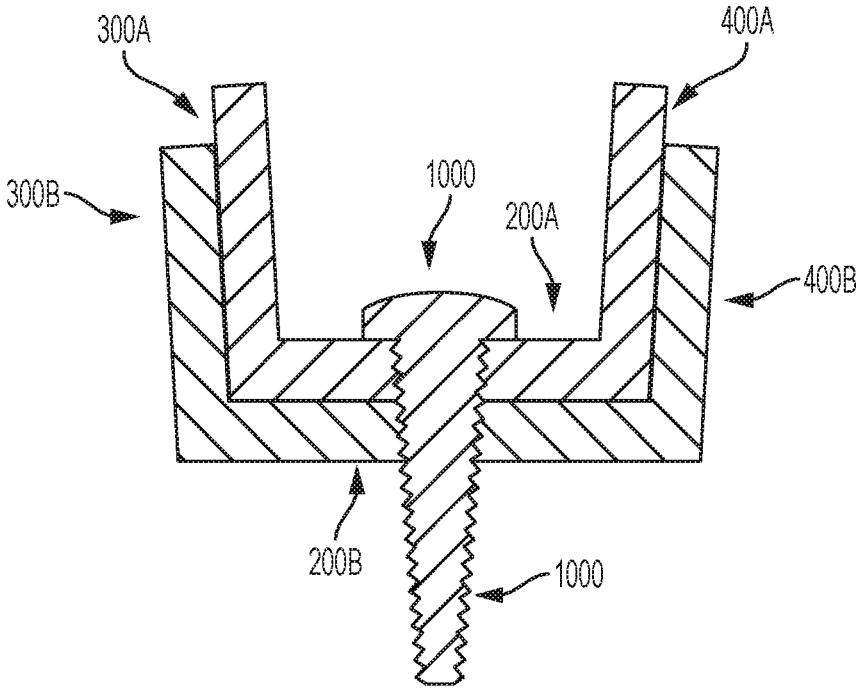
FIG. 14B depicts a cross-section of nested bridge members in a vertical metal framing component which in this embodiment is a stud.

FIG. 14B is the cross section of the nested bridge members at the point of attachment. In this embodiment, the bridges are attached with a screw (1000).

We claim:

1. A stud bridge member comprising:

a stud bridge member width (150);

a web (200) having a web outer side (240), a web inner side (260), a web first edge (210) and a web second edge (220) defining a web plane (250) having a longitudinal axis (500);

a first flange (300) and a second flange (400) extending into a space on the web inner side (260) and opposing each other;

at least one notch set comprising a first notch (600) and a second notch (700);

at least one gusset (900) having a gusset outer apex (941);

wherein the first flange comprises a first flange first edge (320) and a first flange second edge (340) defining a first flange plane (350) with the first flange first edge joined with the web first edge at a first juncture (510) having a first juncture outside angle ($\Theta_{M1}$) from the web outer side to the first flange, with a corresponding explementary inner angle ($\alpha_{M1}$), with the first juncture forming a first juncture line (520) which is substantially parallel to the longitudinal axis;

the second flange (400) comprises a second flange first edge (420) and a second flange second edge (440) defining a second flange plane (450) with the second flange first edge joined with the web second edge at a second juncture (530) having a second juncture outside angle ($\Theta_{M2}$) from the web outer side to the second flange, with a corresponding explementary inner angle ($\alpha_{M2}$), with the second juncture forming a second juncture line (540) which is substantially parallel to the longitudinal axis;

the first juncture line, the first flange first edge, the first flange second edge, the second juncture line, the second flange first edge, and the second flange second edge being substantially parallel to the longitudinal axis;

the first notch comprising a first notch length (620), a first notch width (640) measured perpendicular to the first notch length, and a first notch cut plane (630), wherein the first notch length begins in the first flange (300) at a first flange notch point (680) and extends at least through the first juncture and to a web first notch point (660);

the second notch comprising a second notch length (720), a second notch width (740) measured perpendicular to the second notch length, and a second notch cut plane (730), wherein the second notch length begins in the second flange (400) at a second flange notch point (780) and extends through at least the second juncture to a web second notch point (760);

wherein a line passing from the web first notch point to the web second notch point is perpendicular to the longitudinal axis; and the at least one gusset extends from the first flange second edge to at least the first flange notch point or from the second flange second edge to at least the second flange notch point wherein the stud bridge member is engaged with a vertical metal framing member (800) having a vertical metal framing member hole (810) with vertical metal framing member hole edges (840) and a vertical metal framing member hole depth (820); with the bridge member passing through the vertical metal framing member hole so that the first notch and the second notch are engaged with the vertical metal framing member hole edges; and the distance from the outer gusset apex on the first flange or the second flange to an outer edge of the opposing flange when measured perpendicular to the longitudinal axis is less than the vertical metal framing member hole depth.

2. The stud bridge member of claim 1, wherein the gusset is on the web.

3. The stud bridge member of claim 2, wherein both $\alpha_{M1}$ and $\alpha_{M2}$ have substantially the same value.

4. The stud bridge member of claim 2, wherein at least one of the first notch or second notch is an hourglass notch.

5. The stud bridge member of claim 1, wherein the gusset is on the first flange and the second flange.

6. The stud bridge member of claim 5, wherein the gusset is on the web.

7. The stud bridge member of claim 6, wherein at least one of the first notch or second notch is an hourglass notch.

8. The stud bridge member of claim 5, wherein both $\alpha_{M1}$ and $\alpha_{M2}$ have a value of greater than 90° and less than about 110°.

9. The stud bridge member of claim 8, wherein at least one of the first notch or second notch is an hourglass notch.

10. The stud bridge member of claim 1, wherein at least one of $\alpha_{M1}$ or $\alpha_{M2}$ has a value of greater than 90° and less than about 110°.

11. The stud bridge member of claim 10, wherein the gusset is on the web.

12. The stud bridge member of claim 11, wherein both $\alpha_{M1}$ and $\alpha_{M2}$ have a value of greater than 90° and less than about 110°.

13. The stud bridge member of claim 12, wherein the gusset is on the web.

14. The stud bridge member of claim 12, wherein the gusset is on the first flange and the second flange.

15. The stud bridge member of claim 14, wherein the gusset is on the web.

16. The stud bridge member of claim 10, wherein the gusset is on the first flange and the second flange.

17. The stud bridge member of claim 16, wherein the gusset is on the web.

18. The stud bridge member of claim 10, wherein at least one of the first notch or second notch is an hourglass notch.

19. The stud bridge member of claim 1, wherein both $\alpha_{M1}$ and $\alpha_{M2}$ have substantially the same value.

20. The stud bridge member of claim 1, wherein the distance from the outer gusset apex to the outer edge of the opposing flange when measured perpendicular to the longitudinal axis and parallel with the web plane (950) is less than or equal to the stud bridge member width.

21. The stud bridge member of claim 20, wherein the gusset is on the web.

22. The stud bridge member of claim 20, wherein the gusset is on the first flange and the second flange.

23. The stud bridge member of claim 22, wherein the gusset is on the web.

24. The stud bridge member of claim 20, wherein at least one of $\alpha_{M1}$ or $\alpha_{M2}$ has a value of greater than 90° and less than about 110°.

25. The stud bridge member of claim 24, wherein the gusset is on the web.

26. The stud bridge member of claim 24, wherein the gusset is on the first flange and the second flange.

27. The stud bridge member of claim 26, wherein the gusset is on the web.

28. The stud bridge member of claim 20, wherein at least one of the first notch or second notch is an hourglass notch.

29. The stud bridge member of claim 1, wherein at least one of the first notch or second notch is an hourglass notch.

30. An installation of a stud bridge member (100) and at least a first vertical metal framing member (800) comprising:

the stud bridge member, and the at least a first vertical metal framing member;

the stud bridge member comprising:

a web (200) having a web outer side (240), a web inner side (260), a web first edge (210) and a web second edge (220) defining a web plane (250) having a longitudinal axis (500);

a first flange (300) and a second flange (400) extending into a space on the web inner side (260); and at least one notch set comprising a first notch (600) and a second notch (700), with the first flange comprising a first flange first edge (320) and a first flange second edge (340) defining a first flange plane (350) with the first flange first edge joined with the web first edge at a first juncture (510) having a first juncture outside angle ($\Theta_{M1}$) from the web outer side to the first flange, with a corresponding explementary inner angle ($\alpha_{M1}$), with the first juncture forming a first juncture line (520) which is substantially parallel to the longitudinal axis; the second flange (400) comprising a second flange first edge (420) and a second flange second edge (440) defining a second flange plane (450) with the second flange first edge joined with the web second edge at a second juncture (530) having a second juncture outside angle ($\Theta_{M2}$) from the web outer side to the second flange, with a corresponding explementary inner angle ($\alpha_{M2}$), with the second juncture forming a second juncture line (540) which is substantially parallel to the longitudinal axis; the first juncture line, the first flange first edge, the first flange second edge, the second juncture line, the second flange first edge, and the second flange second edge being substantially parallel with the longitudinal axis;

the first notch comprising a first notch length (620), a first notch width (640) measured perpendicular to the first notch length, and a first notch cut plane (630) wherein the first notch length begins in the first flange at a first flange notch point (680) and extends at least through the first juncture and to a web first notch point (660); the second notch comprising a second notch length (720), a second notch width (740) measured perpendicular to the second notch length, and a second notch cut plane (730), wherein the second notch length begins in the second flange (400) at a second flange notch point (780) and extends through at least the second juncture to a web second notch point (760), wherein either one of, or both, the first notch length and the second notch length do not extend completely across the respective first flange and second flange; and a line passing from the web first notch point to the web second notch point is perpendicular to the longitudinal axis;

the first vertical metal framing member comprising a first vertical metal framing member web, a first vertical metal framing member hole passing through the first vertical metal framing member web with the first vertical metal framing member hole having a first vertical metal framing member hole depth and a first vertical metal framing member hole length;

wherein the bridge member passes through the first vertical metal framing member hole with the first notch and the second notch engaged with the first vertical metal framing member at the first vertical metal framing member hole.

* * * * *